US006197487B1

(12) United States Patent
Ohnuma et al.

(10) Patent No.: US 6,197,487 B1
(45) Date of Patent: Mar. 6, 2001

(54) PHOTOGRAPHIC SUPPORT, SILVER HALIDE PHOTOSENSITIVE PHOTOGRAPHIC MATERIAL AND THERMALLY DEVELOPABLE PHOTOSENSITIVE PHOTOGRAPHIC MATERIAL

(75) Inventors: Kenji Ohnuma; Masahito Takada; Hidetoshi Ezure; Yasuo Kurachi, all of Hino (JP)

(73) Assignee: Konica Corporation, Tokyo (JP)

( * ) Notice: Subject to any disclaimer, the term of this patent is extended or adjusted under 35 U.S.C. 154(b) by 0 days.

(21) Appl. No.: 09/322,544

(22) Filed: May 28, 1999

(30) Foreign Application Priority Data

Jun. 3, 1998 (JP) ..... 10-170625
Aug. 25, 1998 (JP) ..... 10-254547
Sep. 11, 1998 (JP) ..... 10-276565

(51) Int. Cl.[7] ..... G03C 1/76
(52) U.S. Cl. ..... 430/531; 430/533; 428/480

(58) Field of Search ..... 430/531, 533; 428/480

(56) References Cited

U.S. PATENT DOCUMENTS 5,958,659 * 9/1999 Takahashi ..... 430/533
5,968,666 * 10/1999 Carter et al. ..... 428/480
6,060,226 * 5/2000 Hashimoto ..... 430/496

* cited by examiner

*Primary Examiner*—Janet Baxter
*Assistant Examiner*—Amanda C. Walke
(74) *Attorney, Agent, or Firm*—Frishauf, Holtz, Goodman, Langer & Chick, P.C.

(57) ABSTRACT

A support of photographic material is disclosed. The support is composed of plastic film in which polyethylene naphthalate is the major component. The plastic film is thermally treated at a temperature of not less than its Tg of said film to no more than its Tg plus 55° C.

42 Claims, No Drawings

PHOTOGRAPHIC SUPPORT, SILVER HALIDE PHOTOSENSITIVE PHOTOGRAPHIC MATERIAL AND THERMALLY DEVELOPABLE PHOTOSENSITIVE PHOTOGRAPHIC MATERIAL

FIELD OF THE INVENTION

The present invention relates to a silver halide photosensitive photographic material and a thermally developable photosensitive photographic material which are produced on and employed from a wound roll, and a support employed in these photosensitive photographic materials, and specifically to a support for photosensitive photographic materials, which tend not to result in roll-set curl, and exhibits excellent workability.

BACKGROUND OF THE INVENTION

When photosensitive photographic materials are employed in various sizes, from the viewpoint of ease of handling and space saving, the required amount is often taken from the material in a roll form and subsequently employed. Specifically, in the printing and plate making field, a large amount of materials employed are in the form of rolled film.

When the film is employed in such a manner, in terms of workability, a major problem is roll-set curl of the film. For example, problems occur such that during continuous cutting of the film employing an automatic roll cutter, when the roll-set curl is severe, cut film sheets do not pile well; when exposure is carried out upon bringing a sheet of film into contact with an original, insufficient contact and similar problems occur.

In recent years, along with the size reduction of apparatuses, the size of rolled film has tended to decrease, and the size of roll cores has also decreased. Film exhibiting less roll-set curl is thus highly desirable.

As methods to minimize this roll-set curl, for example, Japanese Patent Publication Open to Public Inspection No. 51-16358 proposes that as a method to minimize the roll-set curl of polyester film, thermoplastic film is subjected to thermal treatment at Tg−5° C. to Tg−30° C. for 0.1 to 1,500 hours. Further, Japanese Patent Publication Open to Public Inspection No. 6-35118 proposes that after subbing polyester film having Tg of 90 to 200° C., the resulting film is subjected to thermal treatment at 50° C. to Tg for 0.1 to 1,500 hours.

However, in these methods, thermal treatment at a relatively low temperature for a long period is required and is not efficient in terms of production. Furthermore, when a long roll of film is produced, it must be subjected to thermal treatment for a long period as an intermediate product in the wound-roll state and a problem occurs, such that roll-set curl is caused due to the diameter of the wound core. When it is employed to produce a silver halide photosensitive photographic material in the rolled state, problems occur such that the roll-set curl, previously caused by the above mentioned thermal process, makes it impossible to exhibit sufficient advantages.

These problems are not so serious for silver halide photosensitive photographic materials which are wound on a relatively small core, while they are particularly serious for those such as graphic art materials, etc. which are wound on a relatively large core.

Furthermore, when thermal treatment is carried out in the rolled state, the thermal treatment process has been limited due to problems such as the degradation of flatness, and adherence between contacting surfaces.

SUMMARY OF THE INVENTION

In view of the above-mentioned problems, an object of the present invention is to provide a photographic support which makes it possible to produce a photosensitive photographic material which tends not to result in roll-set curl and exhibits excellent workability for the case of wound photosensitive photographic materials, such as graphic art materials, etc., which are wound on a core having a relatively large diameter.

The present invention and embodiments relevant thereto will now be described.

The support of the present invention is composed of plastic film in which polyethylene naphthalate is the major component, and is prepared by thermally treating said film in the range of not less than its Tg of said film to no more than its Tg plus 55° C. The duration of the thermal treatment is preferably between 5 and 60 minutes.

The thermal treatment is preferably carried out after a sublayer is coated and subsequently dried. The thermal treatment is preferably carried out in such a manner that the plastic film is heated up to a high temperature which does not exceed its Tg+55° C. and is then cooled.

The plastic film is composed of preferably a mixed resin comprising two or more types of polyester resins having different property or component. The plastic film is composed of preferably a mixed resin comprising two or more types of polyester resins having an intrinsic viscosity of 0.3 to 1.2, as well as an intrinsic viscosity difference of 0.2 to 1.0.

At least one of the polyester resins is preferably polyethylene-2,6-naphthalate.

It is preferred that a polyester resin having a lower intrinsic viscosity is incorporated in an amount of 10 to 80 weight percent. Polyester resin having the highest intrinsic viscosity is preferably in an amount of 20 to 90 wt %.

The photographic support may be prepared by mixing at least two types of polyester resins of polyethylene-2,6-naphthalate having different properties.

The ratio $D_{145}/D_{135}$, that is, the ratio of a tan δ value ($D_{145}$) at 145° C., based on dynamic viscoelasticity measurement of the film to a tan δ value ($D_{135}$) at 135° C., based the same measurement is preferably between 0.8 and 1.4.

Film having a specific tan delta may be obtained, for example, by controlling the state of film crystallization or the physical properties of the polymers incorporated into the film. Control of the film crystallization may be carried out by varying the conditions of temperature, cooling rate, and heating rate in the thermal treatment conditions. Furthermore, in order to vary the physical properties, there are methods such as mixing polyesters having different physical properties and appropriately varying the molecular weight and intrinsic viscosity, etc.

Preferred are mixed polyesters consisting of at least two of the same types, or different types of polyesters which exhibit, by at least 30 minutes, the semicrystallizing time difference at 250° C. obtained by the measurement employing a differential scanning calorimeter are preferred.

The semicrystallizing time difference of the resins is preferably at least 5 minutes.

One example of combinations of mixed resins is a polyester resin prepared employing a germanium compound as a polymerization catalyst and a polyester resin prepared by employing an antimony compound as a polymerization catalyst.

DETAILED DESCRIPTION OF THE INVENTION

The thermal treatment of the present invention is different from the conventionally well known annealing treatment which is carried out at a temperature of no more than the Tg of the support in the wound state, and is a method in which the roll-set curl is not likely to be caused by carrying out thermal treatment at a temperature of at least its Tg.

Thermal treatment is preferably carried out after the plastic film is biaxially stretched. It is understood that when biaxially stretched, the plastic film undergoes partial crystallization, and when such film is heated at a temperature exceeding its Tg, some of the crystal structure is relaxed and due to that, the roll-set curl is minimized.

In order to relax the crystallized structure so that it is not lost, it is critical to choose the optimal temperature and duration. Heating is carried out to a temperature exceeding Tg, and is preferably carried out to a temperature which exceeds the Tg by 5° C. The treatment time is dependent on the heating temperature, and at a high temperature, the treatment time is preferably short.

The function of conventional so-called annealing is not to relax the crystal structure but is rather to fix the same. The annealing is carried out at a temperature below its Tg and the crystal structure is unlikely lost. Therefore, the annealing treatment is carried out over a relatively long duration.

In the present thermal treatment, heating is carried out to a temperature exceeding the Tg followed by cooling. The processing time denotes the duration when the temperature exceeds the Tg to the time when the temperature is lowered to the Tg through cooling.

The Tg of the film is preferably between 90 and 200° C.

The heating is preferably carried out in such a manner that one or both surfaces of the film are blown with heated air from a plurality of slits; are subjected to exposure of radiant heat from an infrared heater, etc.; are in contact with a plurality of heated rollers; or are heated by any of these means in combination. The film is to be continually transported and heated preferably in the flat state in such a manner that both surfaces of the film are maintained employing pins or clips, the film is transported employing a plurality of rolls or an air transport is employed in which the film is floated on forced air.

In a roll transport method, because film is transported having a certain holding angle, the film is not perfectly flat. However, the surface and reverse surface are alternatively in contact with rolls and the winding direction of the film is not in the one direction. Accordingly, the film can be regarded as substantially flat.

When the thermal treatment of the present invention is carried out during transporting the film, the transport distance increases in proportion to the thermal treatment time and problems with facilities tend to occur. Due to that, for the transport, a method is preferred in which facilities composed of several dancer rolls are employed so as to enable accumulation, and transport tension is appropriately adjusted. In order to minimize winding wrinkles, the degradation of flatness as well as breakage of the support, the transport tension is adjusted to the range of 5 to 60 kg/m, and the transport tension is preferably between 5 and 30 kg/m.

The transport tension can be adjusted by controlling the torque of a feed shaft and a winding shaft.

In order to sufficiently prevent the roll-set curl of a support without degrading its flatness and transparency, thermal treatment is preferably carried out from 5 to 60 minutes, and is more preferably carried out from 10 to 40 minutes. The thermal treatment time can be adjusted by varying film transporting speed as well as the length of the thermal treatment zone.

The thermal treatment zone as described herein is a plurality of thermal treatment type ovens having different temperature or an apparatus having a plurality of heaters along the transport path, while the film is transported through the apparatus. The temperature at the entry section is set so as to be highest and the temperature of the oven or heater along the transport path is preferably set so as to be the same as or lower than that of the preceding oven or heater.

The temperature of the thermal treatment zone is set so as to be no less than Tg and no more than Tg+55° C. and the temperature of the exit section is set so as to be lower than that of the entry section. The temperature of the entry section is preferably set so as to be in the range of Tg+5 to 35° C. The temperature of the entry section and exit section is acceptable if it is in the range shown above.

Thermally treated film occasionally loses its effects when heated at no less than 100° C. for no less than 30 seconds after the thermal treatment. Due to that, the thermal treatment is preferably carried out during the period after a sublayer has been applied onto the film and dried and before a photosensitive layer is applied onto the resulting coating. Specifically, after coating the sublayer and drying it, continually, coating may be carried out while keeping the resulting coating flat. Or, after winding the coating, the treatment may be carried out by transporting it upon installing necessary transport and heating equipment.

Furthermore, after coating various functional layers such as a backing layer, an electrically conductive layer, a lubricating layer, a magnetic recording layer, etc., and subsequently drying the coating, the same treatments as described previously may be carried out.

The thermally treated film is then cooled to normal temperature and wound up. At the same time, in order to maintain flatness of the film, cooling is preferably carried out as rapidly as possible through Tg to normal temperature, and the rate of cooling is preferably no less than −10° C./second.

The support, which has been thermally treated, cooled to normal temperature, and wound as described above, when stored until it is conveyed to the next process, is preferably wound on a core as large as possible and subsequently stored. The external diameter of the core is preferably at least 200 mm, is more preferably at least 300 mm, and is most preferably at least 400 mm.

The thermal treatment which is carried out in the presence of a large amount of water exhibits more desirable effects. Specifically, the relative humidity of the atmosphere in the thermal treatment zone is preferably set to be between RH 20 and 100 percent, and is more preferably set to be between RH 50 and 100 percent. In addition, when the thermal treatment is carried out at no less than 100° C., heated water vapor may be blown into the zone. Or, when the thermal treatment is carried out at no more than 100° C., the same thermal treatment as described above may be carried out in a water bath set at the thermal treatment temperature.

Further, during storage, the roll-set curl due to storage is preferably minimized by adjusting to the moisture percentage of the film at no more than 1 percent at equilibrium. The moisture percentage of the film is a value obtained by measuring at a dry temperature of 150° C., and by employing a micro moisture meter (for example, CA-05 Type, manufactured by Mitsubishi Kasei Co.).

The rate of crystallization of polyester composing a resin employed in film is obtained by variation of the heat amount accompanied with crystallization in an isothermal crystallization process, employing a differential scanning calorimeter (DSC). Semicrystallization time at 250° C., measured by employing the previously cited differential scanning calorimeter is preferably below 300 minutes in terms of production efficiency, and is more preferably less than 200 minutes. The difference in semicrystallization time between two types of the same or different polyesters is preferably at least 5 minutes due to the ease of minimizing the roll-set curl, is more preferably at least 10 minutes, and is most preferably 30 minutes.

Polyester composing of polyester film is preferably one with film-castable properties having dicarboxylic acid and diol as major composing components.

Dicarboxylic acid as the major component include terephthalic acid, isophthalic acid, phthalic acid, 2,6-naphthalenedicarboxylic acid, 2,7-naphthalenedicarboxylic acid, diphenylsulfonedicarboxylic acid, diphenyetherdicarboxylic acid, diphenylethanedicarboxylic acid, cyclohedxanedicarboxylic acid, diphenylthioetherdicarboxylic acid, diphenylketonedicarboxylic acid, phenylindanedicarboxylic acid, etc.

In addition, diols include ethylene glycol, propylene glycol, tetramethylene glycol, cyclohexanedimethanol, 2,2-bis(4-hydroxyphenyl)propane, 2,2-bis(4-hydroxyethoxyphenyl)propane, bis(4-hydroxyphenyl) sulfone, bisphenol fluorangehydroxyethyl ether, diethylene glycol, neopentyl glycol, hydroquinone, cyclohexanediol, etc.

Preferred polyesters composed of these major composing components, in terms of transparency, mechanical strength, dimensional stability, etc., are those which are composed mainly of terephthalic acid and/or 2,6-naphthalenedicarboxylic acid as the dicarboxylic acid component and ethylene glycol and/or 1,4-cyclohexanedimethanol as the diol component.

Of these, preferred are polyesters composed of polyethylene terephthalate or polyethylene-2,6-naphthalate as the major components, copolymerized polyesters composed of terephthalic acid, 2,6-naphthalenedicarboxylic acid, and ethylene glycol, and polyesters composed of mixtures in combination of two or more of these as the major components. Polyesters composed of polyethylene-2,6-naphthalate as the major component are particularly preferred. It is preferred that polyethylene-2,6-naphthalate be incorporated in an amount of 70 percent of the weight of the film.

The intrinsic viscosity of the mixed polyester is preferably no less than 0.3 to no more than 1.2. At an intrinsic viscosity of less than 0.3, due to the low degree of polymerization, the film casting properties, as well as the strength, is not sufficient, while at an intrinsic viscosity exceeding 1.2, polyester cost is unfavorably raised due to the necessary solid phase polymerization over an extended period. In view of the foregoing, the viscosity of the polyester is preferably is no less than 0.3 to no more than 1.0.

In addition, the intrinsic viscosity difference in the mixed polyesters is preferably as great as possible. In order to increase the intrinsic viscosity difference, it is required to raise the intrinsic viscosity of one of polyesters. However, due to the upper limit of the intrinsic viscosity, the range is inevitably limited. From the above viewpoint, the intrinsic viscosity difference in the polyesters of the present invention is preferably no less than 0.2 to no more than 1, and is more preferably no less than 0.2 to no more than 0.7.

As for the mixing ratio of the polyester resins, the ratio of the polyester resin having a lower intrinsic viscosity, excluding that having the highest intrinsic viscosity, is preferably no less than 10 weight percent to no more than 80 weight percent, and is more preferably no less than 10 weight percent to no more than 50 weight percent.

Polyester composing the biaxially stretched polyester film of the present invention may be further copolymerized with other copolymerizable components or may be mixed with other polyesters, within the range in which the effects of the present invention are not adversely affected. Other polyester resins may be mixed if the intrinsic viscosity difference of the present invention is obtained between at least two polyesters of the same type or different type.

Listed as examples of these can be the above-mentioned dicarboxylic components, and diol components, or polyesters composed of these.

In the case of at least three types of polymers, the total of resins which satisfy the relationship between the difference in the intrinsic viscosity and the difference in the semicrystallizing time of the present invention is preferably at least 50 percent of the total weight, and is more preferably at least 70 percent of the same.

In order to minimize the occurrence of delamination during the storage as film, the polyester of the present invention may be copolymerized with aromatic dicarboxylic acids having a sulfonate group or ester forming derivatives thereof, dicarboxylic acids having a polyoxyalkylene group or ester forming derivatives thereof, diols having a polyoxyalkylene group, etc.

Of these, in terms of the copolymerizing reactivity of the polyester and the film transparency, are preferred 5-sodiumsulfoisophthalic acid, 2-sodiumsulfoterephthalic acid, 4-sodiumsulfophthalic acid, 4-sodiumsulfo-2,6-naphthalenedicarbocylic acid and compounds thereof in which sodium is replaced with other metals (for example, potassium, lithium, etc.) or an ammonium salt, a sulfonium salt, or ester forming derivatives thereof, polyethylene glycol, polytetramethylene glycol, polyethylene glycol-polypropylene glycol copolymer and compounds prepared by oxidizing or so hydroxyl groups at both ends thereof to form carboxyl groups, etc. A ratio of these compounds to be copolymerized is preferably between 0.1 and 10 mole percent with respect to the functional dicarboxylic acid composing the polyester.

For the purpose of increasing heat resistance, bisphenol series compounds, and compounds having a naphthalene ring or cyclohexane ring may be employed for copolymerization. The ratio of copolymerization of these is preferably between 1 and 20 mole percent with respect to the functional dicarboxylic acid composing the polyester.

Polyesters can be produced employing ordinary polyester production methods. For example, a direct esterification method can be employed in which a dicarboxylic acid component and a diol component undergo direct esterification, and an ester exchange method can be employed in which first, dialkyl ester is employed as a dicarboxylic acid component, and the dialkyl ester and a diol component are subjected to ester exchange reaction followed by removing the excessive diol component by heating the resulting compound under reduced pressure. During the reaction process, if desired, an ester exchange catalyst or a polymerization reaction catalyst is employed, or a heat-resistant stabilizer may be added.

As catalysts for synthesis, germanium compounds may be employed. Listed as examples are germanium dioxide, germanium chloride, germanium phosphite, etc. The content of the germanium compound in a polymer is preferably no more than 1.0 mole in terms of the portion of a germanium element of the germanium compound contained in $10^6$ g of the polymer, and is more preferably between 0.05 and 0.8 mole, and is most preferably between 0.05 and 0.6 mole. Further, when the germanium compound contained in $10^6$ g of the polymer exceeds 1.0 mole in terms of the germanium element portion, the rate of the crystallization during repeated heating of a molded product is low and the cost of the obtained resin increases.

Listed as antimony compounds are antimony trioxide, antimony acetate, antimony pentaoxide, etc. The content of the antimony compound in a polymer is preferably no more than 2.0 mole in terms of the portion of an antimony element of the antimony compound contained in $10^6$ g of the polymer, and is more preferably between 0.05 and 1.5 mole, and is most preferably between 0.05 and 1.0 mole. Further, when the antimony compound contained in $10^6$ g of the polymer exceeds 2.0 mole in terms of the antimony element portion, a metal residue remains in the obtained polymer which accelerates the crystallization of the resin. As a result, neither transparent bottles nor molded products can be obtained.

Furthermore, while producing the polyester of the present invention, added may be metal compounds such as magnesium compounds, manganese compounds, cobalt compounds, titanium compounds, etc. The compound forms may be oxides, chlorides, carbonates, carboxylates, acetates, etc. and are not particularly limited. The content of these metal compounds in a polymer is preferably in the range of 0.1 to 3.0 moles in terms of the metal element portion of the metal compound contained in $10^6$ g of the obtained polymer, is more preferably in the range of 0.2 to 2.0 moles, and is most preferably in the rang of 0.3 to 1.5 moles. Further, when the metal compound contained in $10^6$ g of the polymer is no more than 0.1 mole, metal residue remains in the obtained polymer to enhance crystal properties, while when the metal compound exceeds 3.0 moles, yellow staining and insufficient heat resistance are occasionally caused in a polymer.

When this polyester composition is produced, time for adding the above-mentioned metal compounds such as antimony compounds, germanium compounds, magnesium compounds, etc. is not particularly limited, however, these compounds are added at an optional time prior to the polycondensation reaction.

Furthermore, added during each process of the synthesis, may be one type or two types of various additives such as antistaining agents, antioxidants, crystal nucleus agents, lubricating agents, stabilizers, blocking preventing agents, UV absorbers, viscosity controlling agents, antifoaming agents, transparentizing agents, antistatic agents, pH regulators, dyes, pigments, etc.

Into the photographic support of the present invention, antioxidants may be incorporated. There is no practical limitation on the type of the antioxidant incorporated and various types of antioxidants may be employed. These antioxidants include, for example, hindered phenol series compounds, phosphite series compounds, thioether series compounds, etc. Of these, the hindered phenol series compounds are preferred in terms of transparency.

The content of the antioxidant is generally between 0.01 and 2 weight percent, and is preferably between 0.1 and 0.5 weight percent. By limiting the content of the antioxidant to such a range, a photographic support with excellent transparency is obtained, because the increase in density of the unexposed part of a photosensitive photographic material, the so-called fog phenomenon, is minimized, and the haze of the film is kept low. Further, these antioxidants may be employed individually or in combinations of two or more types.

The support of the present invention may be provided with lubricating properties, if desired. As means to provide such lubricating properties, generally employed are an external particle addition method in which fine inactive organic particles are added; an internal particle deposition method in which a catalyst added during polymer polymerization is deposited; or a method in which a surface active agent, etc. are applied onto a film surface. Of these, the internal particle deposition method in which the deposited particles can be controlled to a relatively small size is preferred due to the fact that the lubricating properties are provided without degrading the film transparency.

There is no practical limitation to the thickness of the photographic support of the present invention. The thickness is determined so that necessary strength is obtained responding to the purpose for the usage. Specifically, for photosensitive photographic materials for medical use and graphic art, the thickness is between 50 and 250 $\mu$m, and is preferably between 70 and 200 $\mu$m.

In addition, the haze of the biaxially stretched polyester film of the present invention is preferably no more than 3 percent, and is more preferably no more than 1 percent. When film, having a haze of no less than 3 percent, is employed as a photosensitive photographic support, images becomes unclear. The haze as described herein is that measured according to the ASTM-D1003-52.

The Tg of the biaxially stretched polyester film of the present invention is preferably no less than 90° C., and is more preferably no less than 110° C. The Tg is obtained as the average of temperature at which a base line measured by a differential scanning calorimeter (DSC) starts deviating from the base line and temperature at which initially, the deviation returns to the base line.

A common method employed is one in which an unstretched sheet is prepared and is uniaxially stretched in the longitudinal direction, for example, a method in which polyester as a raw material is molded in a pellet shape and after the resulting molded polyester is dried using heated air or is subjected to vacuum drying, it is melted and extruded; it is extruded into a sheet employing a T die; is brought into contact with a cooling drum employing an electrostatic application method; and is subsequently cooled and solidified to prepare an unstretched sheet. Following that, the obtained unstretched sheet is heated to the range of glass transition temperature (Tg) of the polyester to Tg+100° C. using a plurality of groups of rolls and/or an infrared heater, and is longitudinally stretched. The stretching ratio is usually in the range of 2.4 to 6 times.

In this case, during stretching, by maintaining the temperature of the surface of a support different from that of its opposite surface, it is possible to prevent core-set. Specifically, during heating for longitudinal stretching, the temperature can be controlled by placing heating means such as an infrared heater, etc. on one side of the support. During stretching, the temperature difference between both surfaces is preferably between 10 and 40° C., and is more preferably between 15 and 30° C.

Film, which is longitudinally stretched while being subjected to temperature differences as described above, exhibits excellent effects when the film is converted to a photosensitive photographic material and is wound so that the surface treated with the higher temperature is on the inner side.

Polyester film which has been uniaxially and longitudinally stretched is laterally stretched in the temperature range of Tg and Tg+120° C., and subsequently thermally fixed. The degree of lateral stretching is generally between 3 and 6 times, and the stretching ratio in the longitudinal direction to the lateral direction is suitably regulated so that the resulting biaxially stretched film exhibits preferred characteristics while measuring its physical parameters.

The thermal fixing is generally carried out for 0.5 to 300 seconds at a temperature higher than that applied to the final lateral stretching to no more than Tg+180° C.

A sublayer which may be applied to the support of the present invention will now be described below.

Generally, in cases of employing hydrophilic polymer film as a photographic support, direct application of a hydrophilic photographic emulsion layer onto the polymer film does not result in adequate adhesion force. Therefore, it is required that common polymer film be subjected to surface treatment. The surface treatments for such a purpose include surface-activating treatment methods such as, corona discharge treatment, ultraviolet ray treatment, glow discharge treatment, plasma treatment, flame treatment, and etching treatment methods such as resorcinol treatment, phenols treatment, alkali treatment, amine treatment, trichloroacetic acid treatment, etc. After at least two sublayers are coated and dried, thermal treatment is preferably carried out during coating of an emulsion layer.

Listed as raw materials, to which sublayers may be applied, can be, for example, copolymers prepared by employing starting raw materials such as vinyl chloride, vinylidene chloride, butadiene, methacrylic acid, acrylic acid, itaconic acid, maleic anhydride, and in addition, polyethyleneimine, polyester, polystyrene, polyurethane, epoxy resins, graft gelatin, nitrocellulose, and mixtures thereof. Into these sublayers, may be incorporated one type, or two or more types, of various additives such as surface active agents, antistatic agents, antihalation agents, cross-over cutting agents, dyes, pigments, thickeners, coating aids, antifoggants, antioxidants, UV absorbers, UV stabilizers, etching agents, magnetic powders, matting agents, etc.

Furthermore, may be multicoated an antistatic layer, a readily activated layer, a barrier layer, an antihalation layer, a cross-over cut layer, a UV absorbing layer, a magnetic recording layer, etc.

Methods for coating these sublayers are not particularly limited, and various conventionally known methods may be employed. For example, listed are coating methods such as an air knife coater, a dip coater, a curtain coater, a wire bar coater, a gravure coater, an extrusion coater, and a co-extrusion method during film making of polyester under fusion, a laminating method, etc.

Preferably, the sublayer of the present invention is electrically conductive.

In the present invention, the surface resisitivity (at 23° C. and RH 20 percent) of the surface having an electrically conductive layer is preferably no more than $1\times10^{12}\Omega$, is more preferably no more than $5\times10^{11}\Omega$, and is most preferably $1\times10^{11}\Omega$. In addition, the surface resisitivity (at 23° C. and RH 20 percent) of the surface having the electrically conductive layer after development processing is preferably no more than $1\times10^{12}\Omega$, is more preferably no more than $5\times10^{11}\Omega$, and is most preferably $1\times10^{11}\Omega$.

In the support of the present invention, a layer having electrical conductivity may be in any of the layers as long as it is placed on at least one side of a photosensitive photographic material and an electrically conductive layer may be placed in a silver halide emulsion layer, or a protective layer in a backing layer, the interlayer. The electrically conductive layer may be placed in a thermally developable photographic photosensitive layer, or, at least one layer in a silver halide emulsion layer, or a sublayer between the backing layer and the sublayer may be electrically conductive.

Photographic materials employing the support of the present invention will now be explained.

Photosensitive Photographic Layers

In cases of processing under a reduced replenishment rate or rapid processing, silver halide emulsions comprised of silver chlorobromide containing pure silver chloride of no less than 60 mole percent and comprised of silver chloroiodobromide containing silver chloride of no less than 60 mole percent, is preferably employed.

The average grain diameter of silver halide is preferably not more than 0.7 $\mu$m, and most preferably between 0.5 and 0.1 $\mu$m. A term, "average grain diameter", is generally used with experts in the field of photographic science and easily comprehended. The "grain diameter" denotes a grain diameter when the grain is sphere or can be approximated to a sphere. When the grain is cubic, the sphere having the same volume is obtained and the diameter of the sphere is regarded as the grain diameter. Regarding detailed method to measure the average grain diameter, C. E. Mees and T. H. James, "The Theory of the Photographic Process", Third Edition, pages 36 to 43, 1966, published by Macmillan may be referred.

There is no limitation on the shape of silver halide grains, and the shape may be any of tabular, spherical, cubic, tetradecahedral, regular octahedral shapes or other shapes. Furthermore, the narrower the grain diameter distribution, the more preferred. Particularly, a so-called monodisperse emulsion is preferred in which 90 percent, preferably 95 percent of the number of total grains is in the range of ±40 percent of the average grain diameter.

Regarding silver halide grains, not less than 50 percent of the total of projection area of all the silver halide grains in a layer is preferably occupied by tabular grains having an aspect ratio of not less than 2. Specifically, as the ratio of tabular grains increases from 60 to 70 percent, and still farther to 80 percent, preferred results are obtained. The aspect ratio as described herein denotes a ratio of the diameter of a circle having the same area as the projection area of a tabular grain, to the distance between two parallel planes.

Silver halide emulsions and preparation thereof are described in detail in Research Disclosure Item 176, 17643, pages 22 to 23 (December 1978) and references cited therein.

The silver halide may be or may not be chemically ripened. Sulfur sensitization, selenium sensitization, tellurium sensitization, reduction sensitization and noble metal sensitization are known as the Chemical ripening method in the art, and these method may be employed singly or plurally in combination. Preferable sulfur compound employed in the sulfur sensitization includes sulfur compound contained in gelatin and various sulfur compounds such as thiosulfide, thiourea, rhodanine and polysulfide. Selenium compound preferably employed in selenium sensitization includes those disclosed in U.S. Pat. No. 1,623,499, Japanese Patent Publication Open to Public Inspection Nos. 50-71325 and 60-150046.

Into the light-sensitive material of the present invention, various compounds can be incorporated in order to minimize fog during production process of the light-sensitive material, storage, or photographic processing, or to stabilize photographic properties; namely, many compounds, which are known as antifoggants or stabilizers, can be employed such as azoles, for example, benzothiazolium salts, nitroindazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (particularly, 1-phenyl-5-mercaptotetrazole), etc.; mercaptopyrimidines, mercaptotriazines; thioketo compounds such as, for example, oxazolinethione; azaindenes, for example, triazaindenes, tetraazaindenes (particularly, 4-hydroxy substituted-1,3,3a,7-tetraazaindenes), pentaazaindenes; benzenethiosulfonic acid, benzenesulfinic acid, benzenesulfonic acid amide.

Gelatin is advantageously employed as a photographic emulsion binder or protective colloid. However, besides gelatin, hydrophilic colloids can be employed. For, example, gelatin derivatives, graft polymers of gelatin with other polymers, protein such as albumin, casein, etc.; cellulose derivatives such as hydroxy cellulose, carboxymethyl cellulose, cellulose sulfuric acid ester, etc.; sugar derivatives such as sodium alginate, starch derivatives, etc.; single or copolymer-like hydrophilic synthetic polymers such as polyvinyl alcohol, polyvinyl alcohol partial acetal, poly-N-vinylpyrrolidone, polyacrylic acid, polymethacrylic acid, polyacrylamide, polyvinyl imidazole, polyvinyl pyrazole, etc.

As gelatin, in addition to the lime-treated gelatin, acid-treated gelatin may be employed, and gelatin hydrolyzed products and gelatin enzyme decomposed products can be employed.

In the present invention, a photographic emulsion can be comprised of a dispersion of water-insoluble or hardly water-soluble synthetic polymer for the purpose of improvement in dimensional stability, minimization of silver sludge, etc. For example, employed can be, individually or in combination, alkyl acrylates, alkyl methacrylates, alkoxylacryl acrylates, alkoxylacryl methacrylates, glycidyl acrylate, glycidyl methacrylate, acrylic amide, methacrylic amide, vinyl esters (for example, vinyl acetate), acrylonitrile, oleffins, styrenes, etc., or polymers which are composed of monomer components prepared by combining these with acrylic acid, methacrylic acid, α, β-unsaturated dicarboxylic acids, hydroxyalkyl acrylates, hydroxyalkyl methacrylates, sulfoalkyl acrylates, sulfoalkyl methacrylates, styrene sulfonic acid, etc.

In the present invention, inorganic or organic hardeners may be incorporated into a photographic emulsion and nonlight-sensitive hydrophilic colloid. Hardeners include, for example, chromium salts (chrome alum, chromium acetate, etc.), aldehydes (formaldehyde, glyoxal, glutaraldehyde, etc.), N-methylol compounds (dimethylolurea, methyloldimethylhydantoin, etc.). dioxane derivatives (2,3-dihydroxydioxane, etc.), active vinyl compounds (1,3,5-triacryloyl-hexahydro-s-triazine, bis (vinylsulfonyl) methyl ether, N,N'-metylenebis-[β-(vinylsulfonyl)propionamide], etc.), active halogen compounds (2,4-dichloro-6-hydroxy-s-triazine, etc.), mucohalogenic acids (mucochloric acid, phenoxymucochloric acid, etc.), isoxazoles, dialdehyde starch, 2-chloro-6-hydroxytriadinylated gelatin, isocyanates, carboxyl group active hardeners, etc. These can be employed individually or in combination. The hardening agents are described in detail in Research Disclosure Item 176, 17643, A to C at page 26 (December 1978).

Various additives may be added to the photographic material of the invention. Example thereof includes, desensitizing agent, plasticizer, lubricant, developing accelerator, oil and so on.

It is preferable that the compound described below is contained in a layer of the photographic material of the invention.

(1) Solid Dispersion Fine Particles of Dye

Compounds described at page 3, [0017]–page 16, [0042] in Japanese Patent Publication Open to Public Inspection No. 7-5629.

(2) Compound Containing Acid Group

Compounds described at page 8,–page 25 in Japanese Patent Publication Open to Public Inspection No. 62-237445.

(3) Acid Polymer

Compounds described at page 10, [0036]–page 17, [0062] in Japanese Patent Publication Open to Public Inspection No. 6-186659.

(4) Sensitizing Dye

Compounds described at page 3, [0017]–page 13, [0040] in Japanese Patent Publication Open to Public Inspection No. 5-224330.

Compounds described at page 11, [0042]–page 22, [0094] in Japanese Patent Publication Open to Public Inspection No. 6-194771.

Compounds described at page 2, [0015]–page 8, [0034] in Japanese Patent Publication Open to Public Inspection No. 6-242533.

Compounds described at page 3, [0012]–page 34, [0056] in Japanese Patent Publication Open to Public Inspection No. 6-337492.

Compounds described at page 4, [0013]–page 14, [0039] in Japanese Patent Publication Open to Public Inspection No. 6-337494.

(5) Super Sensitizer

Compounds described at page 3, [0011]–page 16, [0066] in Japanese Patent Publication Open to Public Inspection No. 6-347938.

(6) Hydrazine Derivative

Compounds described at page 23, [0111]–page 32, [0157] in Japanese Patent Publication Open to Public Inspection No. 7-114126.

(7) Nucleation Accelerator

Compounds described at page 32, [0158]–page 36, [0169] in Japanese Patent Publication Open to Public Inspection No. 7-114126.

(8) Tetrazolium Compound

Compounds described at page 8, [0059]–page 10, [0067] in Japanese Patent Publication Open to Public Inspection No. 6-208188.

(9) Pyridinium Compound

Compounds described at page 5, [0028]–page 29, [0068] in Japanese Patent Publication Open to Public Inspection No. 7-111556.

(10) Redox Compound

Compounds described at page 7–page 22 in Japanese Patent Publication Open to Public Inspection No. 4-245243.

(11) Pyridinium Compound

Compounds described in Japanese Patent Publication Open to Public Inspection No. 3-54551.

The additives mentioned above and other additives include compounds described in, for example, Research Disclosure No. 17643 (December, 1978), No. 18716 (November, 1979) and No. 308119 (December, 1989). The compounds described in the three Research Disclosure are listed.

| | (RD 17643) | | (RD 18716) | | (RD 308119) | |
|---|---|---|---|---|---|---|
| Additive | Page | Class | Page | Class | Page | Class |
| Chemical Sensitizers | 23 | III | 648 | Upper Right | 996 | III |
| Spectral Sensitizing Dye | 23 | IV | 648–649 | | 996–998 | IV |
| Desensitizing Dye | 23 | IV | 998 | B | | |
| Dye | 25–26 | VIII | 649–650 | | 1003 | VIII |
| Development Accelerator | 29 | XXI | 648 | Upper Right | | |
| Antifoggants, Stabilizers | 24 | IV | 649 | Upper Right | 1006–1007 | VI |
| Brightening Agents | 24 | V | 998 | V | | |
| Hardeners | 26 | X | 651 | Left | 1004–1005 | X |
| Surfactant | 26–27 | XI | 650 | Right | 1005–1006 | XI |
| Antistatic Agents | 27 | XII | 650 | Right | 1006–1007 | XIII |
| Plasticizers | 27 | XII | 650 | Right | 1006 | XII |
| Lubricant | 27 | XII | | | | |
| Matting Agents | 28 | XVI | 650 | Right | 1008–1009 | XVI |
| Binders | 26 | XXII | 1003–4 | IX | | |

Thermally developable photosensitive materials, which form photographic images employing a thermally developable processing method, are disclosed, for example, in U.S. Pat. Nos. 3,152,904 and 3,457,075, and D. Morgan and B. Shely, "Thermally Processed Silver Systems" (Imaging Processes and Materials, Neblette 8th edition, edited by Sturge, V. Walworth, A. Shepp, page 2, 1969). In the present invention the image is formed by developing the photosensitive material thermally at 80–140° C., and no fix processing is applied. Therefore silver halide or organic silver in unexposed area are not removed and remain in the photosensitive material.

Optical transmittance density at 400 nm of the photosensitive material including a support after development is preferably not more than 0.2, more preferably not more than 0.02.

Silver halide grains of photosensitive silver halide in the present invention work as a light sensor. In order to minimize translucence after image formation and to obtain excellent image quality, the less the average grain size, the more preferred, and the average grain size is preferably less than 0.2 μm; is more preferably between 0.03 and 0.15 μm, and is most preferably between 0.03 and 0.11 μm. The average grain size as described herein denotes an average edge length of silver halide grains, when they are so-called regular crystals of cube or octahedron. Furthermore, when grains are not regular crystals, for example, spherical, cylindrical, and tabular grains, the grain size refers to the diameter of a sphere having the same volume as the silver grain.

Furthermore, silver halide grains are preferably monodisperse grains. The monodisperse grains as described herein refer to grains having a monodispersibility obtained by the formula described below of less than 40 percent; more preferably less than 30 percent, and most preferably between 0.1 and 20 percent.

Monodispersibility=(standard deviation of grain diameter)/(average of grain diameter)×100

The silver halide grain shape is preferred, in which a high ratio occupying a Miller index [100] plane is preferred. This ratio is preferably at least 50 percent; is more preferably at least 70 percent, and is most preferably at least 80 percent. The ratio occupying the Miller index [100] plane can be obtained based on T. Tani, J. Imaging Sci., 29, 165 (1985) in which adsorption dependency of a [111] plane and a [100] plane is utilized.

The average grain diameter of the above-mentioned monodisperse grains is preferably less than 0.1 μm; is more preferably between 0.01 and 0.1 μm, and is most preferably between 0.02 and 0.08 μm. Furthermore, another preferred silver halide shape is a tabular grain. The tabular grain as described herein is a grain having an aspect ratio represented by r/h of at least 3, wherein r represents a grain diameter in μm obtained as the square root of the projection area, and h represents thickness in μm in the vertical direction. Of these, the aspect ratio is preferably between 3 and 50. The grain diameter is preferably not more than 0.1 μm, and is more preferably between 0.01 and 0.08 μm. These are described in U.S. Pat. Nos. 5,264,337, 5,314,789, 5,320,958, and others. In the present invention, when these tabular grains are used, image sharpness is further improved.

The composition of silver halide may be any of silver chloride, silver chlorobromide, silver chloroiodobromide, silver bromide, silver iodobromide, or silver iodide. The photographic emulsion employed in the present invention can be prepared employing methods described in P. Glafkides, "Chimie et Physique Photographique" (published by Paul Montel Co., 1967), G. F. Duffin, "Photographic Emulsion Chemistry" (published by The Focal Press, 1966), V. L. Zelikman et al., "Making and Coating Photographic Emulsion" (published by The Focal Press, 1964), etc. Namely, any of several acid emulsions, neutral emulsions, ammonia emulsions, and the like may be employed. Furthermore, when grains are prepared by allowing soluble silver salts to react with soluble halide salts, a single-jet method, a double-jet method, or combinations thereof may be employed. The resulting silver halide may be incorporated into an image forming layer utilizing any practical method, and at such time, silver halide is placed adjacent to a reducible silver source. Silver halide may be prepared by converting a part or all of the silver in an organic silver salt formed through the reaction of an organic silver salt with halogen ions into silver halide. Silver halide may be previously prepared and the resulting silver halide may be added to a solution to prepare the organic silver salt, or combinations thereof may be used, however the latter is preferred. Generally, the content of silver halide in organic silver salt is preferably between 0.75 and 30 weight percent.

Silver halide is preferably comprised of ions of metals or complexes thereof, in transition metal belonging to Groups VIB, VIIB, VIII and IB of the Periodic Table. As the above-mentioned metals, preferred are Cr and W (in Group VIB); Re (in Group VIIB); Fe, Co, Ni, Ru, Rh, Pd, Os, Ir, and Pt (in group VIII); and Cu and Au (in Group IB). Of these, when employed for printing plate-making photosensitive materials, it is preferred to use Rh, Re, Ru, Ir, or Os.

These metals may be incorporated into silver halide in the form of complexes. In the present invention, regarding the transition metal complexes, six-coordinate complexes represented by the formula described below are preferred.

$(ML_6)^m$:

wherein M represents a transition metal selected from elements in Groups VIB, VIIB, VIII, and IB of the Periodic Table; L represents a coordinating ligand; and m represents 0, −1, −2, or −3.

Specific examples represented by L include halogens (fluorine, chlorine, bromine, and iodine), cyan, cyanato, thiocyanato, selenocyanato, tellurocyanato, each ligand of azido and aquo, nitrosyl, thionitrosyl, etc., of which aquo, nitrosyl and thionitrosyl are preferred. When the aquo ligand is present, one or two ligands are preferably coordinated. L may be the same or different.

The particularly preferred specific example of M is rhodium (Rh), ruthenium (Ru), rhenium (Re) or osmium (Os).

Specific examples of transition metal ligand complexes are described below.

1: $[RhCl_6]^{3-}$
2: $[RuCl_6]^{3-}$
3: $[ReCl_6]^{3-}$
4: $[RuBr_6]^{3-}$
5: $[OsCl_6]^{3-}$
6: $[CrCl_6]^{4-}$
7: $[Ru(NO)Cl_5]^{2-}$
8: $[RuBr_4\ (H_2O)]^{2-}$
9: $[Ru(NO)\ (H_2O)Cl_4]^{-}$
10: $[RhCl_5\ (H_2O)]^{2-}$
11: $[Re(NO)Cl_5]^{2-}$
12: $[Re(NO)CN_5]^{2-}$
13: $[Re(NO)ClCN_4]^{2-}$
14: $[Rh(NO)_2Cl_4]^{-}$
15: $[Rh(NO)(H_2O)Cl_4]^{-}$
16: $[Ru(NO)CN_5]^{2-}$
17: $[Fe(CN)_6]^{3-}$
18: $[Rh(NS)Cl_5]^{2-}$
19: $[Os(NO)Cl_5\ ]^{-}$
20: $[Cr(NO)Cl_5]^{2-}$
21: $[Re(NO)Cl_5]^{-}$
22: $[Os(NS)Cl_4(TeCN)]^{2-}$
23: $[Ru(NS)Cl_5]^{\ 2-}$
24: $[Re(NS)Cl_4(SeCN)]^{2-}$
25: $[Os(NS)Cl(SCN)_4]^{2-}$
26: $[Ir(NO)Cl_5]^{2-}$
27: $[Ir(Ns)Cl_5]^{2-}$

One type of these metal ions or complex ions may be employed and the same type of metals or the different type of metals may be employed in combinations of two or more types.

Generally, the content of these metal ions or complex ions is suitably between $1\times10^{-9}$ and $1\times10^{-2}$ mole per mole of silver halide, and is preferably between $1\times10^{-8}$ and $1\times10^{-4}$ mole.

Compounds, which provide these metal ions or complex ions, are preferably incorporated into silver halide grains through addition during the silver halide grain formation. These may be added during any preparation stage of the silver halide grains, that is, before or after nuclei formation, growth, physical ripening, and chemical ripening. However, these are preferably added at the stage of nuclei formation, growth, and physical ripening; furthermore, are preferably added at the stage of nuclei formation and growth; and are most preferably added at the stage of nuclei formation.

These compounds may be added several times by dividing the added amount. Uniform content in the interior of a silver halide grain can be carried out. As described in Japanese Patent Publication Open to Public Inspection No. 63-29603, 2-306236, 3-167545, 4-76534, 6-110146, 5-273683, etc., incorporation can be carried out so as to result preferably in distribution formation in the interior of a grain.

These metal compounds can be dissolved in water or a suitable organic solvent (for example, alcohols, ethers, glycols, ketones, esters, amides, etc.) and then added. Furthermore, there are methods in which, for example, an aqueous metal compound powder solution or an aqueous solution in which a metal compound is dissolved along with NaCl and KCl is added to a water-soluble silver salt solution during grain formation or to a water-soluble halide solution; when a silver salt solution and a halide solution are simultaneously added, a metal compound is added as a third solution to form silver halide grains, while simultaneously mixing three solutions; during grain formation, an aqueous solution comprising the necessary amount of a metal compound is placed in a reaction vessel; or during silver halide preparation, dissolution is carried out by the addition of other silver halide grains previously doped with metal ions or complex ions. Specifically, the preferred method is one in which an aqueous metal compound powder solution or an aqueous solution in which a metal compound is dissolved along with NaCl and KCl is added to a water-soluble halide solution. When the addition is carried out onto grain surfaces, an aqueous solution comprising the necessary amount of a metal compound can be placed in a reaction vessel immediately after grain formation, or during physical ripening or at the completion thereof or during chemical ripening.

The light sensitive silver halide emulsion is desalted by washing such as noodle method, flocculation method etc. Desalt processing is not required in the invention.

The light sensitive silver halide grains are preferably chemically ripened. The preferable chemical ripening method includes sulfur sensitization, selenium sensitization and tellurium sensitization. Further noble metal sensitization employing gold, platinum, palladium or iridium compound, or reduction sensitization may be applied. Examples of compounds employed in sulfur sensitization, selenium sensitization and tellurium sensitization includes those described in Japanese Patent Publication Open to Public Inspection No. 7-128768. Examples of tellurium compound includes diacyltellurides, bis(oxycarbonyl)tellurides, bis(carbamoyl)tellurides, diacyltellurdes, bis(oxycarbonyl)ditellurides, bis(carbamoyl)ditellurides, compounds containing P—Te bonding, salts of tellurocarbonic acid, Te-organyltellurocarbonic acid esters, telluride, tellurols, telluroacetals, tellurosulfonates, compounds containing P—Te bonding, heterocyclic compounds containing Te, tellurocarbonyl compounds, inorganic tellurium compounds and colloidal tellurium.

Examples of compounds employed in noble metal sensitization includes, auric acid, potassium chloroaurate, potassium aurithiocyanate, gold sulfide, gold selenide, and compounds described in U.S. Pat. No. 2,448,061, British Patent No. 618,061. Concrete examples employed in reduction sensitization includes, in addition to ascorbic acid and thioureadioxide, stannous chloride, aminoisomethanesulfinic acid, hydrazine derivatives, borane compounds, silane compounds and polyamine compounds. Reduction sensitization can be conducted by ripening the emulsion being kept at pH of not less than 7 or at pAg of not more than 8.3. Reduction sensitization can also be conducted by introducing single addition part during the forming silver halide grains.

Organic silver salts employed in the present invention are reducible silver sources and preferred are organic acids and silver salts of hetero-organic acids having a reducible silver ion source, specifically, long chain (having from 10 to 30 carbon atoms, but preferably from 15 to 25 carbon atoms)

aliphatic carboxylic acids and nitrogen-containing heterocyclic rings. Organic or inorganic silver salt complexes are also useful in which the ligand has a total stability constant for silver ion of 4.0 to 10.0. Examples of preferred silver salts are described in Research Disclosure, Items 17029 and 29963, and include the following; organic acid salts (for example, salts of gallic acid, oxalic acid, behenic acid, stearic acid, palmitic acid, lauric acid, etc.); carboxyalkylthiourea salts (for example, 1-(3-carboxypropyl)thiourea, 1-(3-carboxypropyl)-3,3-dimethylthiourea, etc.); silver complexes of polymer reaction products of aldehyde with hydroxy-substituted aromatic carboxylic acid (for example, aldehydes (formaldehyde, acetaldehyde, butylaldehyde, etc.), hydroxy-substituted acids (for example, salicylic acid, benzoic acid, 3,5-dihydroxybenzoic acid, 5,5-thiodisalicylic acid, silver salts or complexes of thioenes (for example, 3-(2-carboxyethyl)-4-hydroxymethyl-4-(thiazoline-2-thioene and 3-carboxymethyl-4-thiazoline-2-thioene), complexes of silver with nitrogen acid selected from imidazole, pyrazole, urazole, 1.2,4-thiazole, and 1H-tetrazole, 3-amino-5-benzylthio-1,2,4-triazole and benztriazole or salts thereof; silver salts of saccharin, 5-chlorosalicylaldoxime, etc.; and silver salts of mercaptides The preferred silver salt is silver behenate.

Organic silver salts can be prepared by mixing a water-soluble silver compound with a compound which forms a complex with silver, and employed preferably are a normal precipitation, a reverse precipitation, a double-jet precipitation, a controlled double-jet precipitation as described in Japanese Patent Publication Open to Public Inspection No. 9-127643, etc. For example, after forming organic acid alkalimetal soap (for example, sodium behenate sodium arginate) by adding alkalimetal salt such as sodiumhydroide, potassium oxide, to organic acid, above mentioned soap and silver nitrate etc. are added to form crystals of organic silver salt. In this instance silver halide grain may be mixed.

In the present invention, organic silver salts have an average grain diameter of 1 $\mu$m and are monodispersed. The average diameter of the organic silver salt as described herein is, when the grain of the organic salt is, for example, a spherical, cylindrical, or tabular grain, a diameter of the sphere having the same volume as each of these grains. The average grain diameter is preferably between 0.01 and 0.8 $\mu$m, and is most preferably between 0.05 and 0.5 $\mu$m. Furthermore, the monodisperse as described herein is the same as silver halide grains and preferred monodispersibility is between 1 and 30 percent. In the present invention, the organic silver salts are preferably composed of monodispersed grains with an average diameter of not more than 1 $\mu$m. When grains are prepared within this range, high density images can be obtained.

Furthermore, another preferred silver halide shape is a tabular grain. The tabular grain as described herein is a grain having an aspect ratio represented by r/h of at least 3, wherein r represents a grain diameter in $\mu$m obtained as the square root of the projection area, and h represents thickness in $\mu$m in the vertical direction. The organic silver crystals are pulverized and dispersed with binder and surfactant by employing ball mills.

In the present invention, in order to achieve the specified optical density, the total amount of silver halides and organic silver salts is preferably between 0.5 and 2.2 g per $m^2$ in terms of silver amount. When prepared within this range, high contrast images can be obtained. Amount of the silver halide to whole silver amount is preferably not more than 50 wt %, more preferably 25 wt %, specifically 0.1–15 wt %.

Reducing agents are preferably incorporated into the thermally developable photosensitive material of the present invention. Examples of suitable reducing agents are described in U.S. Pat. Nos. 3,770,448, 3,773,512, and 3,593,863, and Research Disclosure Items 17029 and 29963, and include the following:

Aminohydroxycycloalkenone compounds (for example, 2-hydroxypiperidino-2-cyclohexane); esters of amino reductones as the precursor of reducing agents (for example, piperidinohexose reducton monoacetate); N-hydroxyurea derivatives (for example, N-p-methylphenyl-N-hydroxyurea); hydrazones of aldehydes or ketones (for example, anthracenealdehyde phenylhydrazone; phosphamidophenols; phosphamidoanilines; polyhydroxybenzenes (for example, hydroquinone, t-butylhydroquinone, isopropylhydroquinone, and (2,5-dihydroxy-phenyl) methylsulfone); sulfydroxamic acids (for example, benzenesulfhydroxamic acid); sulfonamidoanilines (for example, 4-(N-methanesulfonamide)aniline); 2-tetrazolylthiohydroquinones (for example, 2-methyl-5-(1-phenyl-5-tetrazolylthio)hydroquinone); tetrahydroquinoxalines (for example, 1,2,3,4-tetrahydroquinoxaline); amidoxines; azines (for example, combinations of aliphatic carboxylic acid arylhydrazides with ascorbic acid); combinations of polyhydroxybenzenes and hydroxylamines, reductones and/or hydrazine; hydroxamic acids; combinations of azines with sulfonamidophenols; α-cyanophenylacetic acid derivatives; combinations of bis-β-naphthol with 1,3-dihydroxybenzene derivatives; 5-pyrazolones, sulfonamidophenol reducing agents, 2-phenylindane-1,3-dione, etc.; chroman; 1,4-dihydropyridines (for example, 2,6-dimethoxy-3,5-dicarboethoxy-1,4-dihydropyridine); bisphenols (for example, bis(2-hydroxy-3-t-butyl-5-methylphenyl)methane, bis(6-hydroxy-m-tri)mesitol, 2,2-bis(4-hydroxy-3-methylphenyl)propane, 4,5-ethylidene-bis(2-t-butyl-6-methyl)phenol, UV-sensitive ascorbic acid derivatives and 3-pyrazolidones. Of these, particularly preferred reducing agents are hindered phenols.

As hindered phenols, listed are compounds represented by the general formula (A) described below.

General formula (A):

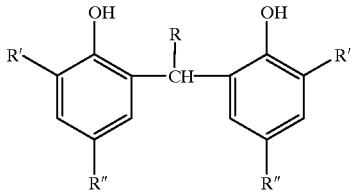

wherein R represents a hydrogen atom or an alkyl group having from 1 to 10 carbon atoms (for example, —$C_4H_9$, 2,4,4-trimethylpentyl), and R' and R" each represents an alkyl group having from 1 to 5 carbon atoms (for example, methyl, ethyl, t-butyl).

Specific examples of the compounds represented by the general formula (A) are described below.

A-1

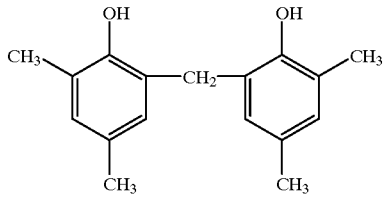

A-2

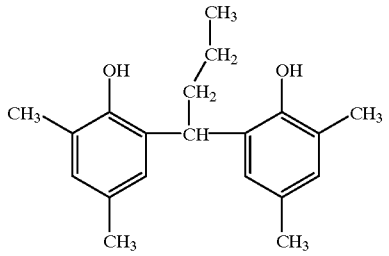

A-3

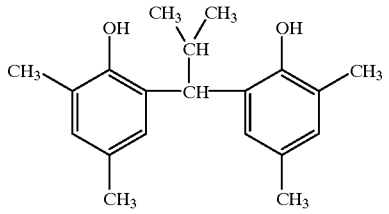

A-4

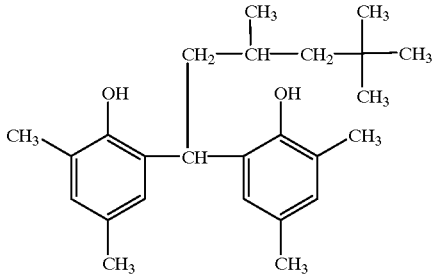

A-5

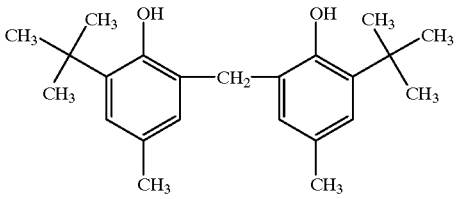

A-6

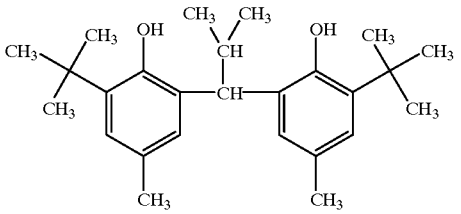

-continued

A-7

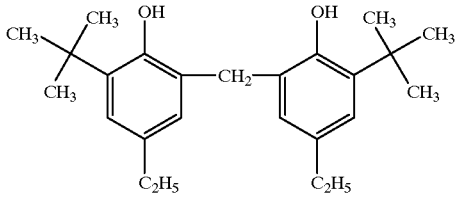

The used amount of reducing agents first represented by the above-mentioned general formula (A) is preferably between $1\times10^{-2}$ and 10 moles per mole of silver, and is most preferably between $1\times10^{-2}$ and 1.5 moles.

Binders suitable for the thermally developable photosensitive material to which the present invention is applied are transparent or translucent, and generally colorless. Binders are natural polymers, synthetic resins, and polymers and copolymers, other film forming media; for example, gelatin, gum arabic, poly(vinyl alcohol), hydroxyethyl cellulose, cellulose acetate, cellulose acetatebutylate, poly (vinylpyrrolidone), casein, starch, poly(acrylic acid), poly (methylmethacrylic acid), poly(vinyl chloride), poly (methacrylic acid), copoly(styrene-maleic acid anhydride), copoly(styrene-acrylonitrile, copoly(styrene-butadiene, poly (vinyl acetal) series (for example, poly(vinyl formal)and poly(vinyl butyral), poly(ester) series, poly(urethane) series, phenoxy resins, poly(vinylidene chloride), poly(epoxide) series, poly(carbonate) series, poly(vinyl acetate) series, cellulose esters, poly(amide) series. These may be hydrophilic or hydrophobic. A nonlight-sensitive layer may be provided at the outer side of the light sensitive layer for the purpose of protecting the surface of the photosensitive material or preventing scratches. Binders employed in the nonlight-sensitive layer may be the same or different species as that of light sensitive layer.

In the present invention, the amount of the binder in a photosensitive layer is preferably between 1.5 and 10 g/m$^2$, and is more preferably between 1.7 and 8 g/m$^2$ so as to obtain desirable density of image.

In the present invention, a matting agent is preferably incorporated into the photosensitive layer side. In order to minimize the image abrasion after thermal development, the matting agent is provided on the surface of a photosensitive material and the matting agent is preferably incorporated in an amount of 0.5 to 30 per cent in weight ratio with respect to the total binder in the emulsion layer side.

Materials of the matting agents employed in the present invention may be either organic substances or inorganic substances. Regarding inorganic substances, for example, those can be employed as matting agents, which are silica described in Swiss Patent No. 330,158, etc.; glass powder described in French Patent No. 1,296,995, etc.; and carbonates of alkali earth metals or cadmium, zinc, etc. described in U.K. Patent No. 1.173,181, etc. Regarding organic substances, as organic matting agents those can be employed which are starch described in U.S. Pat. No. 2,322,037, etc.; starch derivatives described in Belgian Patent No. 625,451, U.K. Patent No. 981,198, etc.; polyvinyl alcohols described in Japanese Patent Publication No. 44-3643, etc.; polystyrenes or polymethacrylates described in Swiss Patent No. 330,158, etc.; polyacrylonitriles described in U.S. Pat. No. 3,079,257, etc.; and polycarbonates described in U.S. Pat. No. 3,022,169.

The shape of the matting agent may be crystalline or amorphous. However, a crystalline and spherical shape is preferably employed. The size of a matting agent is expressed in the diameter of a sphere which has the same volume as the matting agent. The particle diameter of the matting agent in the present invention is referred to the diameter of a spherical converted volume.

The matting agent employed in the present invention preferably has an average particle diameter of 0.5 to 10 $\mu$m, and more preferably of 1.0 to 8.0 $\mu$m. Furthermore, the variation coefficient of the size distribution is preferably not more than 50 percent, is more preferably not more than 40 percent, and is most preferably not more than 30 percent.

The variation coefficient of the size distribution as described herein is a value represented by the formula described below.

(Standard deviation of particle diameter)/(average particle diameter)×100

The matting agent according to the present invention can be incorporated into arbitrary construction layers. In order to accomplish the object of the present invention, the matting agent is preferably incorporated into construction layers other than the photosensitive layer, and is more preferably incorporated into the farthest layer from the support surface.

Addition methods of the matting agent according to the present include those in which a matting agent is previously dispersed into a coating composition and is then coated, and prior to the completion of drying, a matting agent is sprayed. When a plurality of matting agents are added, both methods may be employed in combination.

The thermally develpable photosensitive material forms a photographic image by thermal development, and contains, preferably, reduceable silver source (organic silver), light sensitive silver halide, reducing agent and toning agent control color if required dispersed in ordinarily (organic) binder matrix.

Thermally developable photosensitive materials are stable at normal temperature, and after exposure, when they are heated to high temperatures (for example, between 80 and 140 ° C.), they are developed. Upon heating them, silver is formed through an oxidation-reduction reaction of an organic silver salt (working as an oxidizing agent) with a reducing agent. This oxidation-reduction reaction is accelerated with a catalytic action of a latent image formed in photosensitive silver halide by exposure. Silver formed by the reaction of an organic silver salt in an exposed area provides a black image. This is in contrast to the unexposed area, and thereby forms an image. This reaction process proceeds without providing a processing solution such as water from the outside.

The thermally developable photosensitive material comprises a support having thereon at least one photosensitive layer, and the photosensitive layer may only be formed on the support. Further, at least one nonphotosensitive layer is preferably formed on the photosensitive layer. In order to control the amount or wavelength distribution of light transmitted through the photosensitive layer, a filter layer may be provided on the same side as the photosensitive layer, or on the opposite side. Dyes or pigments may also be incorporated into the photosensitive layer.

In the nonlight-sensitive layer preferably contains above mentioned binder and matting agent, and may contain a lubricant such as polysiloxane compound, wax, fluid paraffin.

The light sensitive layer may be formed as plural layers, and in this case higher sensitivity layer is positioned at the inner layer or outer layer for the purpose of contrast control.

Image color control agents are preferably incorporated into the thermally developable photosensitive material of the present invention. Examples of suitable image color control agents are disclosed in Research Disclosure Item 17029, and include the following:

imides (for example, phthalimide), cyclic imides, pyrazoline-5-ons, and quinazolinon (for example, succinimide, 3-phenyl-2-pyrazoline-5-on, 1-phenylurazole, quinazoline and 2,4-thiazolidion); naphthalimides (for example, N-hydroxy-1,8-naphthalimide); cobalt complexes (for example, cobalt hexaminetrifluoroacetate), mercaptans (for example, 3-mercapto-1,2,4-triazole); N-(aminomethyl) aryldicarboxyimides (for example, N-(dimethylaminomethyl)phthalimide); blocked pyrazoles, isothiuronium derivatives and combinations of certain types of light-bleaching agents (for example, combination of N,N'-hexamethylene(1-carbamoyl-3,5-dimethylpyrazole), 1,8-(3,6-dioxaoctane)bis(isothiuroniumtrifluoroacetate), and 2-(tribromomethylsulfonyl)benzothiazole; merocyanine dyes (for example, 3-ethyl-5-((3-ethyl-2-benzothiazolinylidene(benzothiazolinylidene))-1-methylethylidene-2-thio-2,4-oxazolidinedione); phthalazinone, phthalazinone derivatives or metal salts thereof (for example, 4-(1-naphthyl)phthalazinone, 6-chlorophthalazinone, 5,7-dimethylphthalazinone, and 2,3-dihydro-1,4-phthalazinedione); combinations of phthalazinone and sulfinic acid derivatives (for example, 6-chlorophthalazinone+benzenesulfinic acid sodium or 8-methylphthalazinone+p-trisulfonic acid sodium); combinations of phthalazine+phthalic acid; combinations of phthalazine (including phthalazine addition products) with at least one compound selected from maleic acid anhydride, and phthalic acid, 2,3-naphthalenedicarboxylic acid or o-phenylenic acid derivatives and anhydrides thereof (for example, phthalic acid, 4-methylphthalic acid, 4-nitrophthalic acid, and tetrachlorophthalic acid anhydride); quinazolinediones, benzoxazine, naphtoxazine derivatives, benzoxazine-2,4-diones (for example, 1,3-benzoxazine-2,4-dione); pyrimidines and asymmetry-triazines (for example, 2,4-dihydroxypyrimidine), and tetraazapentalene derivatives (for example, 3,6-dimercapto-1,4-diphenyl-1H,4H-2,3a,5,6a-tatraazapentalene). Preferred image color control agents include phthalazone or phthalazine.

A mercapto compound, disulfide compound or thion compound may be incorporated in for controlling the development to accelerate or retard, improving efficiency of optical sensitization, improving preserve ability of the photosensitive material before or after development.

The mercapto compound is preferably that represented by Ar—SM, Ar—S—S—Ar, wherein M is a hydrogen or alkalimetal atom, Ar is an aromatic cycle or condensed aromatic cycle containing at least one of nitrogen, sulfur, selenium or tellurium. The preferable heterocycle examples includes benzimidazole, naphthimidazole, benzothizole, naphththiazole, benzooxazole, naphthooxazole, benzoselenazole, benzotetrazole, imidazole, oxazole, pyrrazole, triazole, thiadiazole, tetrazole, triazine, pyrimidine, pyridazine, pyrazine, pyridine, purine, quinoline, or quinazoline. The heterocycle may have a substituent that is selected from a group consisting of halogen (Br or Cl), hydroxy, amino, carboxy, alkyl (for example, those having at least one carbon atom, preferably 1–4 carbon atoms), and alkoxy (for example, those having at least one carbon atom, preferably 1–4 carbon atoms). Examples of mercapto substituted heterocyclic compound include 2-mercaptobenzimidazole, 2-mercaptobenzoxazole, 2-mercaptobenzthiazole, 2-mercapto-5-methylbenzothiazole, 3-mercapto-1,2,4-triazole, 2-mercaptoquinoline, 8-mercaptopurine, 2,3,5,6-tetrachloro-4-pyridinediol, 4-hydroxy-2-mercaptopyrimidine, 2-mercapto-4-phenyloxazole.

Antifoggants may be incorporated into the thermally developable photosensitive material to which the present invention is applied. The substance which is known as the most effective antifoggant is a mercury ion. The incorporation of mercury compounds as the antifoggant into photosensitive materials is disclosed, for example, in U.S. Pat. No. 3,589,903. However, mercury compounds are not environmentally preferred. As mercury-free antifoggants, preferred are those antifoggants as disclosed in U.S. Pat. Nos. 4,546,075 and 4,452,885, and Japanese Patent Publication Open to Public Inspection No. 59-57234.

Particularly preferred mercury-free antifoggants are heterocyclic compounds having at least one substituent, represented by -C(X1)(X2)(X3) (wherein X1 and X2 each represents halogen, and X3 represents hydrogen or halogen), as disclosed in U.S. Pat. No. 3,874,946 and U.S. Pat. No. 4,756,999. As examples of suitable antifoggants, employed preferably are compounds and the like described in paragraph numbers [0062] and [0063] of Japanese Patent Publication Open to Public Inspection No. 9-90550.

Furthermore, more suitable antifoggants are disclosed in U.S. Pat. No. 5,028,523, and U.K. Patent Application Nos. 9221383. No. 4, 9300147. No. 7, and 9311790. No. 1.

In the thermally developable photosensitive material of the present invention, employed can be sensitizing dyes described, for example, in Japanese Patent Publication Open to Public Inspection Nos. 63-159841, 60-140335, 63-231437, 63-259651, 63-304242, and 63-15245; U.S. Pat. Nos. 4,639,414, 4,740,455, 4,741,966, 4,751,175, and 4,835,096. Useful sensitizing dyes employed in the present invention are described, for example, in publications described in or cited in Research Disclosure Items 17643, Section IV-A (page 23, December 1978), 1831, Section X (page 437, August 1978). Particularly, selected can advantageously be sensitizing dyes having the spectral sensitivity suitable for spectral characteristics of light sources of various types of scanners. For example, dyes are preferably selected from compounds described in Japanese Patent Publication Open to Public Inspection Nos. 9-134078, 9-54409 and 9-80679.

Various additives may be incorporated in one of the light sensitive layer non light sensitive layer or other constituting layer. The photosensitive material may be employ a surfactant, anti-oxidant, stabilizer, plasticizer, UV ray absorbent or coating aid. The example of these additives and additives mentioned above is disclosed in Research Disclosure 17029 (June, 1978, pages 9–15).

EXAMPLES

The present invention will be more specifically explained with reference to examples.

Example 1

Preparation of Polyester (Resin)

(PET-A)

According to an ordinary method, ester exchange was carried out by adding 0.05 weight part of magnesium acetate hydrate as an ester exchange catalyst to 100 weight parts of dimethyl phthalate and 65 weight parts of ethylene glycol. To the obtained product were added 0.05 weight part of antimony trioxide and 0.03 part of trimethyl phosphate ester. The resulting mixture was then gradually heated while reducing pressure, and polymerization was carried out at 280° C. and at 0.5 mmHg to obtain polyethylene terephthalate A, (PET-A) with an intrinsic viscosity of 0.50.

(PET-B-1)

Polyethylene terephthalate B (PET-B-1) with an intrinsic viscosity of 0.34 was obtained in the same manner as PET-A.

(PEN-A)

According to an ordinary method, ester exchange was carried out by adding 0.05 weight part of magnesium acetate hydrate as an ester exchange catalyst to 122 weight parts of 2,6-dimethylnaphthalene dicarboxylate and 69 weight parts of ethylene glycol. To the obtained product were added 0.04 weight part of antimony trioxide and 0.03 weight part of trimethyl phosphate ester. The resulting mixture was then gradually heated while reducing pressure, and polymerization was carried out at 290° C. and at 0.5 mmHg to obtain polyethylene-2,6-naphthalate A (PEN-A) with an intrinsic viscosity of 0.58.

(PEN-B-1)

Polyethylene-2,6-naphthalate B (PEN-B) with an intrinsic viscosity of 0.30 was obtained in the same manner as PEN-A.

(PEN-C)

After provisionally crystallizing PEN-A at 130° C. for 2 hours, solid phase polymerization was carried out at 215° C. under a nitrogen gas flow to obtain polyethylene-2,6-naphthalate C (PEN-C) having an intrinsic viscosity of 0.87.

(PEN-D-1)

According to a common method, ester exchange was carried out by adding 0.1 weight part of magnesium acetate hydrate as an ester exchange catalyst to a mixture of 100 weight parts of 2,6-dimethylnaphthalene dicarboxylate and 56 weight parts of ethylene glycol added with 4.1 parts of 1,4-butanediol (5 mole percent). To the obtained product were added 0.04 weight part of antimony trioxide and 0.1 weight part of trimethyl phosphate ester. The resulting mixture was then gradually heated while reducing pressure, and polymerization was carried out at 285° C. and at 0.5 mmHg to obtain polyethylene-2,6-naphthalate D (PEN-D-1) with an intrinsic viscosity of 0.40.

Employing each of the polyester resins prepared as described above, biaxially stretched polyester Supports 1 through 14 were prepared as described below.

Preparation of Supports (Support-1)

After drying at 150° C. for 8 hours under vacuum, pelletized PET-A was melted and extruded from a T die in a laminated state at 285° C.; it was then brought into contact with a cooling drum at 30° C. under electrostatic application; and was cooled and solidified to obtain unstretched film. The resulting unstretched film was longitudinally stretched by a factor of 3.3 times at 80° C. employing a roll system longitudinal stretching apparatus. The obtained uniaxially stretched film was stretched employing a Tainter system lateral stretching apparatus so that at in a first stretching zone, total lateral stretching of 50 percent was carried at 90° C. and in a second stretching zone, the total lateral stretching of 3.3 times was carried out at 100° C. Subsequently, the stretched film was subjected to pre-thermal treatment at 70° C. for 2 seconds, was thermally fixed at 150° C. for 5 seconds in a first fixing zone, and was thermally fixed at 220° C. for 15 seconds in a second fixing zone, and was cooled to room temperature over 60 seconds while carrying out a 5 percent relaxing treatment in the lateral direction. The resulting film was released from clips and was wound to obtain biaxially stretched film having a thickness of 90 μm.

(Support-2)

Another 90 μm biaxially stretched film was prepared in the same manner as Support 1, except that PET-A in Support 1 was replaced with PEN-A, the melt-extrusion temperature was changed to 30 0° C., the cooling drum temperature to 50 0° C., the longitudinal stretching temperature to 135° C., the first lateral stretching zone temperature to 145° C., the second lateral stretching temperature to 155° C., the pre-thermal treatment temperature to 100° C., the first fixing zone temperature to 200° C., and the second fixing zone temperature to 230° C.

(Support-3)

PET-A and PEN-A were mixed using a tumbler mixer so as to obtain the blending ratio shown in Table 1. A biaxially stretched film having a thickness of 90 μm was prepared in the same manner as Support 1, except that the base casting conditions were changed as follows: the melt-extrusion temperature to 295° C., the cooling drum temperature to 45° C., the longitudinal stretching temperature to 110° C., the first lateral stretching zone temperature to 125° C., the second lateral stretching temperature to 135° C., the pre-thermal treatment temperature to 85° C., the first fixing zone temperature to 180° C., and the second fixing zone temperature to 225° C.

(Support-4)

PET-A and PEN-A in Support 3 were replaced with PET-B and PEN-C, which were blended employing the same method so as to obtain the blending ratio as shown in Table 1. Further, base casting was carried out employing the same temperatures as those of Support 3.

(Support-5 through Support-14)

Two types of polyester resins were blended in the same manner as above, except that PET-A and PEN-A in Support 3 were replaced with polyester resins having the blending ratio shown in Table 1. Base casting was carried out employing the same temperature as those of Support 2.

Sublayer Coating and Thermal Treatment

The surface of one side of each support prepared as above was subjected to corona discharge treatment of 8 W/($m^2$/minute), and onto the resulting surface, each of sublayer coating compositions A-1 and A-2 described below was applied so as to obtain a dried layer thickness of A-1 and A-2 of 0.8 μm and 0.1 μm, respectively. Further, the surface of the reverse subjected to corona discharging treatment of 8 W/($m^2$/minute), and onto the resulting surface, each of g compositions A-1 and A-2 described below was applied so as to obtain a dried layer thickness of A-1 and A-2 of 0.8 and 0.1 μm, respectively. Thereafter, the resulting coating was subjected to thermal treatment while transporting it through a thermal treatment type oven having a film transport apparatus (with a length of zone of 100 m) equipped with a plurality of groups of rolls. At the time, the entry temperature, exit temperature, and thermal treatment time were varied as shown in Table 2. The thermal treatment time as described herein denotes a passing time through the thermal treatment type oven when the line speed is varied.

<Subbing Coating Composition A-1>

| | |
|---|---|
| Copolymer latex comprised of: butyl acrylate 30 weight percent, t-butyl acrylate 20 percent weight, styrene 25 weight percent, and 2-hydroxyethyl acrylate 25 weight percent (solid portion 30 percent) | 270 g |
| Compound (UL-1) | 0.6 g |
| Hexamethylene-1,6-bis(ethylene urea) | 0.8 g |
| Water to make | 1000 ml |

<Sublayer Coating Composition B-1>

| | |
|---|---|
| Copolymer latex comprised of: butyl acrylate 40 weight percent, styrene 20 weight percent, and glycidyl acrylate 40 weight percent (30 percent of the solid portion) | 270 g |
| Compound (UL-1) | 0.6 g |
| Hexamethylene-1,6-bis(ethyleneurea) | 0.8 g |
| Water to make | 1000 ml |

<Sublayer Coating Composition A-2>

| | |
|---|---|
| Gelatin | 10 g |
| Compound (UL-1) | 0.2 g |
| Compound (UL-2) | 0.2 g |
| Compound (UL-3) | 0.1 g |
| Silica particles (having an average diameter of 3 μm) | 0.1 g |
| Water to make | 1000 ml |

<Sublayer Coating Composition B-2>

| | |
|---|---|
| Water-soluble electrically conductive polymer (UL-4) | 60 g |
| Latex composed of compound (UL-5) (20 percent of the solid portion) | 80 g |
| Ammonium sulfate | 0.5 g |
| Hardener (UL-6) | 12 g |
| Polyethylene glycol (having a weight average molecular weight of 600) | 6 g |
| Water to make | 1000 ml |

UL-1

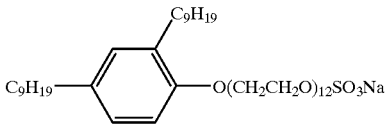

UL-2

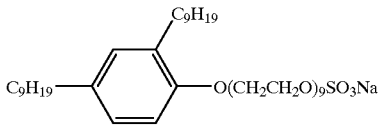

UL-3

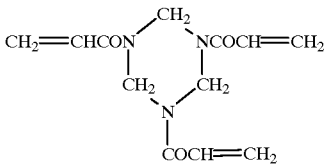

UL-4

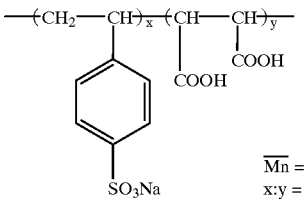

$\overline{Mn}$ = 5000
x:y = 75:25 (weight ratio)

-continued

UL-5

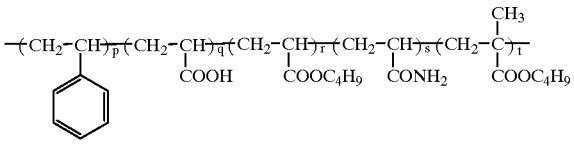

p:q:r:s:t = 40:5:10:5:40 (weight ratio)

UL-6

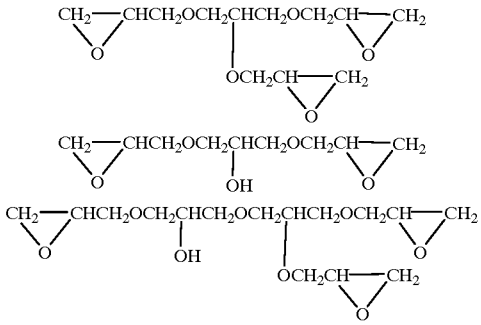

mixture of the 3 types above

A sublayer was applied to a polyester support prepared employing the methods described above; the resulting support was then subjected to thermal treatment while conveying it in the range of Tg+55° C. to Tg, and was coated with the silver halide photosensitive photographic materials and thermally developable photosensitive materials described below.

Coating of a Silver Halide Photographic Emulsion Layer and a Backing Layer

The Emulsion Layer and Backing Layer described below, were coated onto obtained supports A-2 and B-2. Further, coating was carried out so as to obtain a coated gelatin amount of 2.7 g/m$^2$ on the emulsion side including the gelatin in the emulsion, that of 2.7 g/m$^2$ on the backing layer side, and that of 5.0 g/m$^2$ in total.

(Emulsion Preparation)

A silver nitrate solution and an aqueous sodium chloride and potassium bromide solution, to which a hexachlororhodium complex was added so as to obtain $8\times10^{-5}$ mole/mole of Ag, were added to a gelatin solution employing a double jet method while controlling the flow rate, and by carrying out desalting, monodisperse silver chlorobromide emulsion was obtained which was comprised of cubic crystals with a grain diameter of 0.13 $\mu$m containing 1 mole percent of silver bromide. The resulting emulsion underwent sulfur sensitization employing a conventional method, was added with 4-hydroxy-6-methyl-1,3,3a,7-tetraazaindene as a stabilizer, and was then added with the additives described below to prepare emulsion coating compositions.

<Preparation of Emulsion Coating Composition>

| | |
|---|---|
| Gelatin | 1.0 g/m$^2$ |
| Compound (a) | 1 mg/m$^2$ |
| NaOH (0.5N) | pH is adjusted to 5.6 |
| Compound (b) | 40 mg/m$^2$ |
| Compound (c) | 30 mg/m$^2$ |
| Saponin (20 percent aqueous solution) | 0.5 ml/m$^2$ |
| Sodium dodecylbenzenesulfonate | 20 mg/m$^2$ |
| 5-Methylbenzotriazole | 10 mg/m$^2$ |
| Compound (d) | 2 mg/m$^2$ |
| Compound (e) | 10 mg/m$^2$ |

-continued

| | |
|---|---|
| Compound (f) | 6 mg/m$^2$ |
| Latex (m) | 1.0 /m$^2$ |
| Styrene-maleic acid copolymer (thickener) | 90 mg/m$^2$ |

<Emulsion Protective Layer Coating Composition>

| | |
|---|---|
| Gelatin | 0.5 g/m$^2$ |
| Compound (g) (1% aqueous solution) | 25 ml/m$^2$ |
| Compound (h) | 120 mg/m$^2$ |
| Spherical monodisperse silica (8 $\mu$m) | 20 mg/m$^2$ |
| Spherical monodisperse silica (3 $\mu$m) | 10 mg/m$^2$ |
| Compound (i) | 100 mg/m$^2$ |
| Latex (m) | 0.5 g/m$^2$ |
| Citric acid | pH is adjusted to 6.0 |

(Backing Layer Coating Composition)

| | |
|---|---|
| Gelatin | 0.8 g/m$^2$ |
| Compound (j) | 100 mg/m$^2$ |
| Compound (k) | 18 mg/m$^2$ |
| Compound (l) | 100 mg/m$^2$ |
| Saponin (20% aqueous solution) | 0.6 ml/m$^2$ |
| Latex (m) | 300 mg/m$^2$ |
| 5-Nitroindazole | 20 mg/m$^2$ |
| Styrene-maleic acid copolymerizable polymer (thickener) | 45 mg/m$^2$ |
| Glyoxal | 4 mg/m$^2$ |

(Backing Protective Layer Coating Composition)

| | |
|---|---|
| Gelatin | 0.5 g/m$^2$ |
| Compound (g) (1% aqueous solution) | 2 ml/m$^2$ |
| Spherical polymethylmethacrylate (4 $\mu$m) | 25 mg/m$^2$ |
| Sodium chloride | 70 mg/m$^2$ |
| Glyoxal | 22 mg/m$^2$ |
| Compound (n) | 10 mg/m$^2$ |
| Latex (m) | 0.5 g/m$^2$ |

(a)

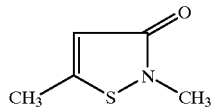

(b)

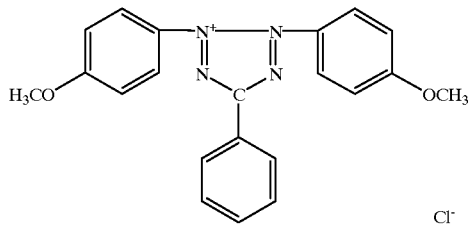

-continued (c)

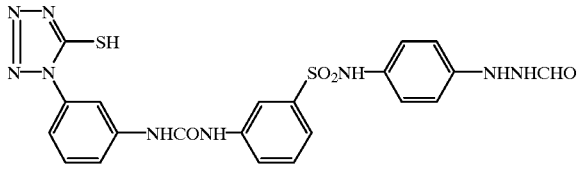

(d)

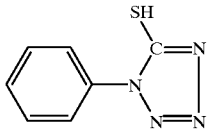

(e)

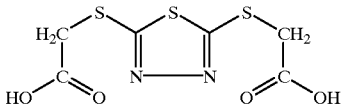

(f)

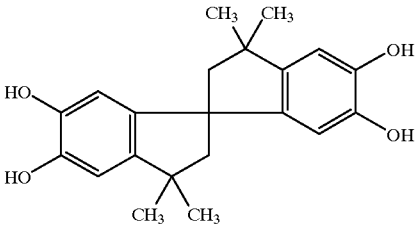

(g)

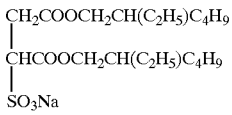

(h)

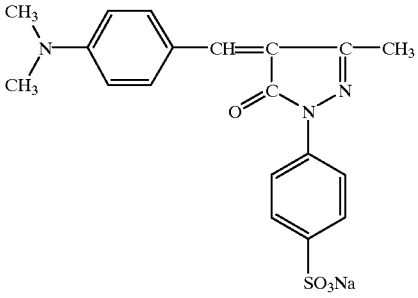

(i)

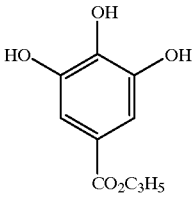

-continued (j)

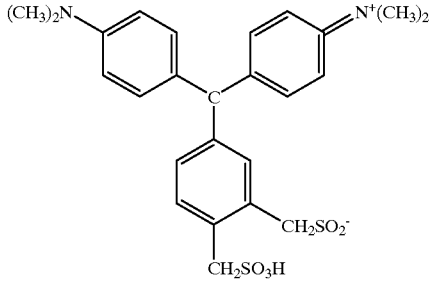

(k)

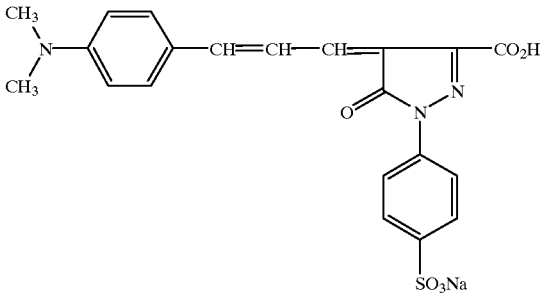

(l)

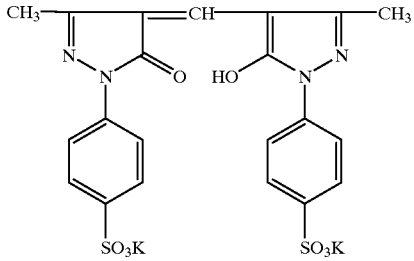

(m)

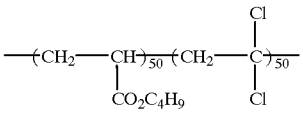

(n)

Coating of Thermally Developable Photosensitive Layer

In 900 ml of water, 7.5 g of inert gelatin and 10 mg of potassium bromide were dissolved and after adjusting the temperature to 35° C. and the pH to 3.0, 370 ml of an aqueous solution containing 74 g of silver nitrate, an aqueous solution containing potassium bromide and potassium iodide with the mole ratio of 98/2, $1\times10^{-6}$ mole of $Ir(NO)Cl_5$ per mole of silver, and $1\times10^{-4}$ of a rhodium chloride salt were added employing a controlled double jet method while maintaining pAg at 7.7. Thereafter, 4-hydroxy-6-methyl-1,3,3a,7-tetraazaindne was added and the pH was adjusted to 5 employing NaOH, and cubic silver iodobromide grains were obtained which had an average grain size of 0.06 $\mu$m, a variation coefficient of a projection diameter area of 8 percent, and an [100] face ratio of 87 percent. The resulting emulsion was coagulated employing a gelatin coagulant and was desalted. Thereafter, 0.1 g of phenoxyethanol was added, and the pH and pAg were adjusted to 5.9 and 7.5, respectively, so that silver halide emulsion was obtained. Furthermore, chemical sensitization was carried out employing chloroauric acid and inorganic sulfur.

(Preparation of Sodium Behenate Solution)

In 945 ml of deionized water, 32.4 g of behenic acid, 9.9 g of arachizinic acid, and 5.6 g of stearic acid were dissolved at 90° C. Next, while stirring the resulting mixture at a high speed, 98 ml of an aqueous 1.5M sodium hydroxide solution was added. Next, after adding 0.93 ml of concentrated nitric acid, the resulting mixture was cooled to 55° C. and was stirred for 30 minutes so that a sodium behenate solution was obtained.

(Preparation of Preform Emulsion of Silver Behenate and Silver Halide A)

To the above-mentioned sodium behenate solution, 15.1 g of the above-mentioned silver halide emulsion A was added, and the pH was adjusted to 8.1 employing a sodium hydroxide solution. Thereafter, 147 ml of a 1M silver nitrate solution was added over 7 minutes and the resulting mixture was stirred for 20 minutes, and water-soluble salts were removed employing ultrafiltration. The resulting silver behenate was composed of grains having an average grain size of 0.8 $\mu$m and a monodispersibility of 8 percent. After forming the flocculation of the dispersion, water was removed and further washing and water removal was carried out six times, after which drying was carried out.

(Preparation of Photosensitive Emulsion)

To the prepared preform emulsion, 544 g of a methyl ethyl ketone solution (17 weight percent) of polyvinyl butyral (having an average molecular weight of 3,000) and 107 g of toluene were gradually added and the resulting mixture was then dispersed at 4,000 psi.

Samples were prepared by forming each layer described below successively onto the above-mentioned support. Further, each sample was dried at 60° C. for 15 minutes.

Coating on the reverse side: coating composition having the composition described below was applied.

| | |
|---|---|
| Cellulose acetate (10% methyl ethyl ketone solution | 15 ml/m$^2$ |
| Dye-B | 7 mg/m$^2$ |
| Dye-C | 7 mg/m$^2$ |
| Matting agent: monodisperse silica having a monodispersibility of 15% and an average particle size of 10 $\mu$m | 30 mg/m$^2$ |
| $C_9H_{17}$—$C_6H_4$—$SO_3Na$ | 10 mg/m$^2$ |

Dye-B

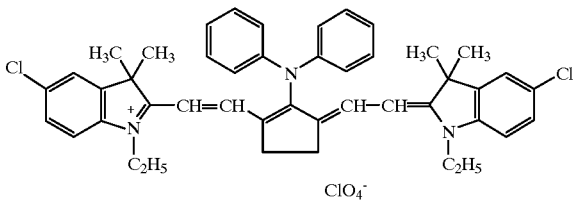

-continued

Dye-C

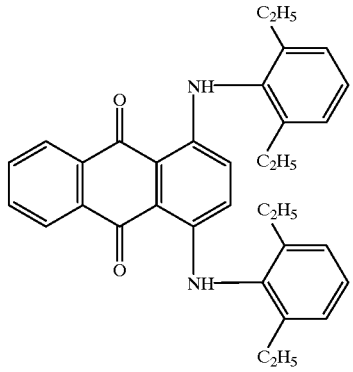

Coating onto the Surface of Photosensitive Layer Photosensitive Layer 1: a coating composition having the composition described below was coated to obtain a coated silver amount of 2.1 g/m$^2$.

| | |
|---|---|
| Preform emulsion | 240 g |
| Sensitizing dye-1 0.1% methanol solution) | 1.7 ml |
| Pyridinium bromide (6% methanol solution) | 3 ml |
| Calcium bromide (0.1% methanol solution) | 1.7 ml |
| Antifoggant-2 (10% methanol solution) | 1.2 ml |
| 2-(4-Chlorobenzoylbenozoic acid) (12% methanol solution) | 9.2 ml |
| 2-Mercaptobenzimidazole (1% methanol solution) | 11 ml |
| Tribromomethylsulfoquinoline (5% methanol solution) | 17 ml |
| Developer-1 (20% methanol solution) | 29.5 ml |

Sensitizing dye-1

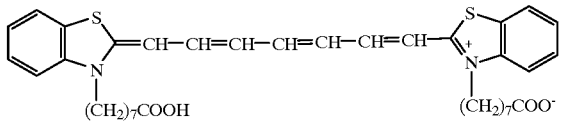

Antifoggant-2

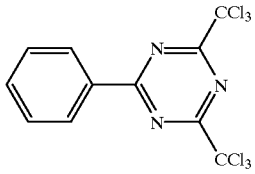

Developer-1

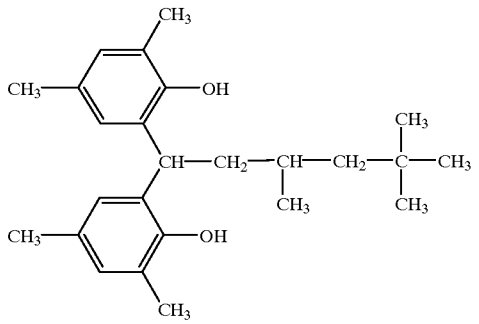

Surface Protective Layer: a coating composition having the composition described below was applied:

| | |
|---|---|
| Acetone | 35 ml/m$^2$ |
| Methyl ethyl ketone | 17 ml/m$^2$ |
| Cellulose acetate | 2.3 g/m$^2$ |
| Methanol | 7 ml/m$^2$ |
| Phthalazine | 250 mg/m$^2$ |
| 4-Methylphthalic acid | 180 mg/m$^2$ |
| Tetrachlorophthalic acid | 150 mg/m$^2$ |
| Tetrachlorophthalic anhydride | 170 mg/m$^2$ |
| Matting agent: monodisperse silica having a monodispersibility 10 percent and an average particle size of 4 $\mu$m | 70 mg/m$^2$ |
| $C_9H_{17}$—$C_6H_4$—$SO_3Na$ | 10 mg/m$^2$ |

Samples prepared as above were evaluated as described below and the results are shown in Tables 1 and 2.

(Evaluation Method)

Intrinsic Viscosity

Pellets or film was dissolved in a mixed solvent of phenol and 1,1,2,2-tetrachloroethane (weight ratio of 60/40), and solutions having a concentration of 0.2 g/dl, 0.6 g/dl and 1.0 g/dl were prepared. Specific viscosity ($\eta_{sp}$) at each concentration (C) at 20° C. was obtained employing a Uberode-type viscometer. Next, $\eta_{sp}/C$ was plotted against C and the obtained linear line was extrapolated to zero concentration and the intrinsic viscosity was calculated according the formula below:

$$\text{Intrinsic viscosity}[\eta] = \lim_{C \to 0} (\eta_{sp} / C)$$

The unit is represented by dl/g. Table 1 shows the values of the intrinsic viscosity of each pellets and films.

Glass Transition Temperature Tg

Ten mg of a support or pellets were melted at 300° C. under a nitrogen gas flow of 300 ml/minute and was rapidly cooled in liquid nitrogen. The rapidly cooled sample was placed in a differential scanning calorimeter (DSC8280 type, manufactured by Rigaku Denki Co.), and was heated at the rate of 10° C./minute under a nitrogen gas flow of 300 ml/minute and Tg was detected. Tg was obtained as an average value of the temperature at which the base line resulted in deviation and temperature at which the deviation initially to the base line. Further, the temperature at which measurement was initiated was 50° C. less than Tg. Table 1 shows the Tg of each support.

Roll-set Curl

A 30 mm wide and 150 mm long support which had been subjected to thermal treatment and a silver halide photosensitive photographic material prepared by applying a photographic emulsion layer onto the support thereof were left for one day under conditions of 23° C. and RH 55 percent for moisture adjustment, were then wound on a winding core having a diameter of 8 mm and were fixed so that each support did not to return to the initial state. Subsequently, in such state, samples were placed in an aluminum barrier bag and were subjected to treatment at 80° C. for 2 hours. After that, each support was released from the winding core and was stored for one hour under conditions of 23° C. and RH 55 percent. Thereafter, curl was measured using a curl gauge. The employed unit was m$^{-1}$.

Rise Curl

A thermally developable photosensitive material which was prepared by applying a thermally developable photosensitive layer onto a 30 mm by 210 mm long support which had been subjected to thermal treatment was stored for one day under conditions of 23° C. and RH 55 percent for moisture adjustment, was then wound with the photosensitive surface facing inside, on a winding core having a diameter of 50 mm and was fixed so that the support did not return to the original state. Next, in such a sate, the wound material was placed in a aluminum barrier bag, was subjected to thermal treatment for 4 hours under conditions of 55° C. and RH 20 and was then cooled for one hour under conditions of 23° C. and RH 55% percent. Thereafter, the material was removed from the winding core. The material was then placed so that the convex portion of the support faced upward placed above and the heights of the support rise at four corners were measured and averaged. The unit was mm.

Evaluation on Support Flatness

A support which had been subjected to thermal treatment was cut to 60×100 cm (width×length) and placed on a flat stand. The support was visually inspected for unevenness.

A: flatness is excellent and the support appears to closely adhere to the surface of the stand B: random wrinkles are observed C: the support exhibits waves as a whole due to wrinkling.

TABLE 1

| | Polyester Resin 1 | | | Polyester Resin 2 | | | Intrinsic | Intrinsic | |
|---|---|---|---|---|---|---|---|---|---|
| | Type | Intrinsic Viscosity | Blending Ratio | Type | Intrinsic Viscosity | Blending Ratio | Viscosity of Support | Viscosity Difference | Tg (° C.) |
| Support 1 | PET-A | 0.50 | 1.00 | — | — | — | 0.50 | — | 75 |
| Support 2 | PEN-A | 0.58 | 1.00 | — | — | — | 0.58 | — | 118 |
| Support 3 | PET-A | 0.50 | 0.29 | PEN-A | 0.58 | 0.71 | 0.53 | 0.08 | 107 |
| Support 4 | PET-B-1 | 0.34 | 0.29 | PEN-C | 0.87 | 0.71 | 0.70 | 0.43 | 107 |
| Support 5 | PEN-A | 0.58 | 0.08 | PEN-C | 0.87 | 0.92 | 0.83 | 0.29 | 118 |
| Support 6 | PEN-A | 0.58 | 0.22 | PEN-C | 0.87 | 0.78 | 0.79 | 0.29 | 118 |

TABLE 1-continued

| | Polyester Resin 1 | | | Polyester Resin 2 | | | Intrinsic | Intrinsic | |
|---|---|---|---|---|---|---|---|---|---|
| | Type | Intrinsic Viscosity | Blending Ratio | Type | Intrinsic Viscosity | Blending Ratio | Viscosity of Support | Viscosity Difference | Tg (° C.) |
| Support 7 | PEN-A | 0.58 | 0.48 | PEN-C | 0.87 | 0.52 | 0.72 | 0.29 | 118 |
| Support 8 | PEN-B-1 | 0.30 | 0.08 | PEN-C | 0.87 | 0.92 | 0.81 | 0.57 | 118 |
| Support 9 | PEN-B-1 | 0.30 | 0.22 | PEN-C | 0.87 | 0.78 | 0.73 | 0.57 | 118 |
| Support 10 | PEN-B-1 | 0.30 | 0.48 | PEN-C | 0.87 | 0.52 | 0.57 | 0.57 | 118 |
| Support 11 | PEN-B-1 | 0.30 | 0.08 | PEN-A | 0.58 | 0.92 | 0.54 | 0.28 | 118 |
| Support 12 | PEN-B-1 | 0.30 | 0.22 | PEN-A | 0.58 | 0.78 | 0.50 | 0.28 | 118 |
| Support 13 | PEN-B-1 | 0.30 | 0.48 | PEN-A | 0.58 | 0.52 | 0.44 | 0.28 | 118 |
| Support 14 | PEN-D-1 | 0.40 | 0.33 | PEN-C | 0.87 | 0.67 | 0.70 | 0.47 | 118 |

TABLE 2

| | Thermal Treatment Conditions | | | | | | |
|---|---|---|---|---|---|---|---|
| | Thermal Treatment Zone | Thermal Treatment Zone | Thermal Treat- | Core-set Curl | | Rise Curl Thermally Develop- | |
| Type of Support | Temperature at Entry | Temperature at Exit | ment Time (in minute) | Support only with Sublayer | Silver Halide Material | able Photosensitive Material | Support Flatness |
| Support 1 | 120 | 80 | 15 | 111 | 228 | 47 | C |
| Support 2 | 185 | 120 | 15 | 75 | 126 | 44 | B |
| Support 2 | 155 | 120 | 60 | 70 | 118 | 30 | B |
| Support 2 | 155 | 120 | 30 | 68 | 114 | 24 | A |
| Support 2 | 155 | 120 | 15 | 70 | 118 | 30 | A |
| Support 2 | 135 | 120 | 30 | 68 | 114 | 24 | A |
| Support 2 | 135 | 120 | 15 | 72 | 121 | 36 | A |
| Support 3 | 155 | 120 | 30 | 88 | 147 | 45 | A |
| Support 3 | 155 | 120 | 15 | 92 | 153 | 47 | A |
| Support 3 | 135 | 120 | 15 | 90 | 150 | 53 | A |
| Support 4 | 155 | 120 | 15 | 78 | 130 | 53 | A |
| Support 5 | 155 | 120 | 15 | 70 | 118 | 30 | A |
| Support 6 | 155 | 120 | 15 | 68 | 114 | 24 | A |
| Support 7 | 155 | 120 | 15 | 68 | 114 | 24 | A |
| Support 8 | 155 | 120 | 15 | 72 | 121 | 36 | A |
| Support 9 | 155 | 120 | 15 | 73 | 122 | 39 | A |
| Support 10 | 155 | 120 | 15 | 88 | 114 | 24 | A |
| Support 11 | 155 | 120 | 15 | 70 | 118 | 30 | A |
| Support 12 | 155 | 120 | 15 | 70 | 118 | 30 | A |
| Support 13 | 155 | 120 | 15 | 68 | 114 | 24 | A |
| Support 14 | 155 | 120 | 15 | 77 | 129 | 38 | A |

As can be clearly seen from Table 2, in the supports of the present invention and those which are subjected to thermal treatment, the core-set curl is markedly minimized and the support flatness is also improved.

Example 2

Preparation of Polyester (Resin)

(PET-B-2)

Polyethylene terephthalate B (PET-B-2) was prepared by polymerization in the same manner as PET-A, except that the catalyst series of PET-A was replaced with germanium dioxide and trimethylphosphate.

(PEN-B-2)

Polyethylene-2,6-naphthalate B (PEN-B-2) having an intrinsic viscosity of 0.58 was prepared in the same manner as PEN-A.

(PEN-D-2)

Polyethylene-2,6-naphthalate D (PEN-D-2) was prepared by polymerization in the same manner as PEN-A, except that the catalyst series of PEN-A was replaced with germanium dioxide and trimethylphophate.

Employing each of the polyester resins prepared as described above, a biaxially stretched polyester film support was prepared as described below.

Preparation of Supports

Sample 21

After drying pelletized PET-A prepared in Example 1 at 150° C. for 8 hours under vacuum, it was melted and extruded from a T die in a laminated state at 285° C.; was brought into contact with a cooling drum at 30° C. under electrostatic application; and was cooled and solidified to obtain unstretched film. The resulting unstretched sheet was longitudinally stretched 3.3 times at 80° C. employing a roll system longitudinal stretching apparatus. The obtained uniaxially stretched film was stretched employing a Tainter system lateral stretching apparatus so that at in a first stretching zone, total lateral stretching of 50 percent was carried at 90° C. and in a second stretching zone, the total lateral stretching of 3.3 times was carried out at 100° C. Subsequently, the stretched film was subjected to pre-thermal treatment at 70° C. for 2 seconds, was thermally fixed at 150° C. for 5 seconds in a first fixing zone, and was thermally fixed at 220° C. for 15 seconds in a second fixing zone, and was cooled to room temperature over 60 seconds while carrying out a 5 percent relaxing treatment in the lateral direction. The resulting film was released from clips and was wound to obtain biaxially stretched film having a thickness of 90 μm.

Sample 22

Film casting was carried out employing the same blending method, except that PET-A in Sample 21 was replaced with PET-B-2.

Sample 23

A biaxially stretched film having a thickness of 90 μm was prepared in the same manner as Sample 25, except that PET-A in Sample 21 was replaced with PEN-A prepared in Example 2, the melt-extrusion temperature was changed to 30° C., the cooling drum temperature to 50° C., the longitudinal stretching temperature to 135° C., the first lateral stretching zone temperature to 145° C., the second lateral stretching temperature to 155° C., the pre-thermal treatment temperature to 100° C., the first fixing zone temperature to 200° C., and the second fixing zone temperature to 230° C.

Sample 24

PET-A and PET-B-2 were blended using a tumbler mixer so as to obtain a weight ratio of 1:1. A biaxially stretched film having a thickness of 90 μm was prepared in the same manner as Comparative Example 1, except that the film casting conditions were changed to a melt-extrusion temperature of 295° C., a cooling drum temperature of 45° C., a longitudinal stretching temperature of 110° C., a first lateral stretching zone temperature of 125° C., a second lateral stretching temperature of 135° C., a pre-thermal treatment temperature of 85° C., a first fixing zone temperature of 180° C., and a second fixing zone temperature of 225° C.

Sample 25

PET-A and PEN-D-2 were blended using a tumbler mixer so as to obtain a weight ratio of 1:1. A biaxially stretched film having a thickness of 50 μm was prepared in the same manner as Comparative Example 1, except that the film casting conditions were changed to a melt-extrusion temperature of 300° C., a cooling drum temperature of 50° C., a longitudinal stretching temperature of 135° C., a first lateral stretching zone temperature of 145° C., a second lateral stretching temperature of 155° C., a pre-thermal treatment temperature of 100° C., a first fixing zone temperature of 200° C., and a second fixing zone temperature of 230° C.

Sample 26

Film casting was carried out employing the same method for blending, except that PEN-A and PEN-D-2 in Support 24 were replaced with PEN-A and PEN-B-2.

Sample 27

Film casting was carried out employing the same method for blending, except that PEN-A and PEN-D-2 in Support 25 were replaced with PEN-A and PEN-C.

Sample 28

Film casting was carried out employing the same method as Sample 25, except that the weight ratio of PEN-A, PEN-B-2, and PEN-C were blended to obtain 1:1:3, respectively.

Sublayer Coating and Thermal Treatment

The surface of one side of each support, prepared as above, was subjected to corona discharge treatment of 8 W/(m$^2$/minute), and onto the resulting surface, each of sublayer coating compositions A-1 and A-2 employed in Example 1 was applied so as to obtain a dried layer thickness of A-1 and A-2 of 0.8 μm and 0.1 μm, respectively. Furthermore, the surface of the reverse side was subjected to corona discharge treatment of 8 W/(m$^2$/minute), and onto the resulting surface, each of sublayer coating compositions B-1 and B-2 described below was applied so as to obtain a dried layer thickness of B-1 and B-2 of 0.8 μm and 0.1 μm, respectively.

A silver halide photosensitive photographic material and a thermally developable photosensitive material were coated in the same manner as for Example 1 onto a polyester film support which had been coated with a sublayer and had been subjected to thermal treatment.

Semicrystallizing Time

Employing a similar differential scanning calorimeter, Sample was heated at 300° C. and was maintained in the molten state for 10 minutes, immediately followed by cooling to 250° C. (at a temperature decrease rate of 20° C./minute). Regarding the peak accompanied with exothermic crystallization, the period from the time when isothermal crystallization started to the time when the area reaches its half was denoted the semicrystallization time.

TABLE 3

| | Blended Resins | | Semicrystallization Time Difference | |
|---|---|---|---|---|
| | Type | Type | (in minutes) | Tg (° C.) |
| Sample 21 | PET-A | | — | 80 |
| Sample 22 | PET-B-2 | | — | 78 |
| Sample 23 | PEN-A | | — | 117 |
| Sample 24 | PEN-D-2 | | — | 118 |
| Sample 25 | PET-A | PET-B-2 | 7 | 116 |
| Sample 26 | PEN-A | PEN-D-2 | 70 | 118 |
| Sample 27 | PEN-A | PEN-B-2 | 55 | 119 |
| Sample 28 | PEN-A | PEN-C | 90 | 117 |
| Sample 29 | PEN-A,B-2,C | | 40 | 118 |

| | Roll-set curl | | Rise Curl Thermally | |
|---|---|---|---|---|
| | Support only with Sublayer | Silver Halide Photosensitive Material | Developable Photosensitive Material | Support Flatness |
| Sample 21 | 145 | 220 | 47 | C |
| Sample 22 | 130 | 230 | 44 | C |
| Sample 23 | 88 | 144 | 45 | B |
| Sample 24 | 90 | 138 | 40 | B |
| Sample 25 | 88 | 147 | 30 | A |
| Sample 26 | 78 | 130 | 24 | A |
| Sample 27 | 80 | 129 | 24 | A |
| Sample 28 | 83 | 131 | 36 | A |
| Sample 29 | 88 | 135 | 36 | A |

As can clearly be seen from Table 3, in the case of the supports of the present invention and those which has been subjected to thermal treatment, the core-set curl is markedly minimized and the support flatness is also improved.

Example 3

Preparation of Polyester (Resin)

(PEN-B-3)

Polyethylene-2,6-naphthalate B (PEN-B-3) having an intrinsic viscosity of 0.37 was prepared in the same manner as PEN-A.

Preparation of Supports

Employing each of the polyester resins prepared as described above, biaxially stretched polyester film supports of Comparative Example and the present invention were prepared as described below.

Sample 31

After drying pelletized PET-A prepared in Example 1 at 150° C. for 8 hours under vacuum, it was melted and extruded from a T die in a laminated state at 285° C.; was brought into contact with a cooling drum at 30° C. during electrostatic application; was cooled and solidified to obtain unstretched film. The resulting unstretched film was longitudinally stretched 3.3 times at 80° C. employing a roll system longitudinal stretching apparatus. The obtained uniaxially stretched film was stretched employing a Tainter system lateral stretching apparatus so that in a first stretching zone, total lateral stretching of 50 percent was carried at 90 ° C. and in a second stretching zone, the total lateral stretching of 3.3 times was carried out at 100° C. Subsequently, the stretched film was subjected to pre-thermal treatment at 70° C. for 2 seconds, was thermally fixed at 150° C. for 5 seconds in a first fixing zone, and was thermally fixed at 220° C. for 15 seconds in a second fixing zone, and was cooled to room temperature over 60 seconds while carrying out 5 percent relaxing treatment in the lateral direction. The resulting film was released from clips and was wound to obtain biaxially stretched film having a thickness of 90 μm.

Sample 32

The film prepared in the same manner as Sample 31 was coated with a sublayer employing the method described below and the resulting coating was subjected to thermal treatment at 110° C. for 10 hours while in a rolled state.

Sample 33

PET-A and PEN-B-3 were blended using a tumbler mixer so as to obtain the weight ratio of 1:1. A biaxially stretched film having a thickness of 90 μm was prepared in the same manner as Example 1, except that the film casting conditions were changed to a melt-extrusion temperature of 295° C., a cooling drum temperature of 45° C., a longitudinal stretching temperature of 110° C., a first lateral stretching zone temperature of 125° C., a second lateral stretching temperature of 135° C., a pre-thermal treatment temperature of 85° C., a first fixing zone temperature of 180° C., and a second fixing zone temperature of 225° C.

Sample 34

Film prepared in the same manner as Sample 31 was coated with a sublayer employing the method described below and was subjected to thermal treatment while cooling from 155° C. to 120° C. over 30 minutes during conveyance in the flat state.

Sample 35

Film prepared in the same manner as Sample 33 was coated with a sublayer employing the method described below and was subjected to thermal treatment while cooling from 155° C. to 120° C. over 30 minutes during the conveyance in a flat state.

Sample 36

PEN-A and PEN-C were blended using a tumbler mixer so as to obtain the weight ratio of 1:1. A biaxially stretched film having a thickness of 90 μm was prepared in the same manner as Comparative Example 1, except that the film casting conditions were changed to a melt-extrusion temperature of 295° C., a cooling drum temperature of 45° C., a longitudinal stretching temperature of 110° C., a first lateral stretching zone temperature of 125° C., a second lateral stretching temperature of 135° C., a pre-thermal treatment temperature of 85° C., a first fixing zone temperature of 180° C., and a second fixing zone temperature of 225° C. Subsequently, the resulting film was coated with a sublayer and the resulting coating was subjected to thermal treatment while cooling from 155° C. to 120° C. over 30 minutes during conveyance in the flat state.

A silver halide photosensitive photographic material and a thermally developable photosensitive material were coated onto a polyester film support which had been coated with a sublayer employing the method described below and had been subjected to thermal treatment.

Sublayer Coating

The surface of one side of each of the support prepared as above was subjected to corona discharge treatment of 8 W/($m^2$/minute), and onto the resulting surface, each of sublayer coating compositions A-1 and A-2 described in Example 1 was applied so as to obtain a dried layer thickness of A-1 and A-2 of 0.8 μm and 0.1 μm, respectively. Furthermore, the surface of the reverse side was subjected to corona discharge treatment of 8 W/($m^2$/minute), and onto the resulting surface, each of sublayer coating compositions B-1 and B-2 described below was applied so as to obtain a dried layer thickness of B-1 and B-2 of 0.8 μm and 0.1 μm, respectively.

Water-soluble electrically conductive polymer (UL-4) 60 g

Coating of Silver Halide Photographic Emulsion Layer and Backing Layer

Employing an obtained support, each of (emulsion layer) and (backing layer) was coated onto A-2 and B-2 to prepare a sample as a silver halide photosensitive photographic material.

Samples prepared as described above were subjected to the evaluation described below. Table 1 shows the results.

(Evaluation Method)

tan δ

Dynamic viscoelasticity of Samples cut into a length 20 mm and width 10 mm size was measured in tension synthesized wave oscillation mode (at sine oscillation frequencies of 0.05 Hz, 0.1 Hz, 0.2 Hz, 0.5 Hz, and 1 Hz) and in the measurement temperature range of 40 to 220° C. (at a rate of increase of 4 ° C.). Regarding measurement results at the frequency of 0.05 Hz, $D_{135}$ represents a value of tan δ at 135° C. and $D_{145}$ represent the same at 145° C.

Evaluation on Support Flatness

Evaluation was carried out in the same manner as Example 1.

TABLE 4

| | Sample 31 | Sample 32 | Sample 33 | Sample 34 | Sample 35 | Sample 36 |
|---|---|---|---|---|---|---|
| Blended Resins | PEN-A | PEN-A PEN-B-3 | PEN-A | PEN-A | PEN-A PEN-B-3 | PEN-A PEN-C |
| Blending Ratio | 100:0 | 50:50 | 100:0 | 100:0 | 50:50 | 50:50 |
| Thermal Treatment | none | none | 110° C. | cooled slowly | cooled slowly | cooled slowly |
| $D_{145}/D_{135}$ | 1.41 | 1.11 | 1.64 | 1.38 | 1.07 | 1.05 |
| Sublayer only Support Curl | 150 | 135 | 80 | 88 | 88 | 78 |
| With Emulsion Support Curl | 160 | 165 | 135 | 144 | 147 | 130 |
| Thermally Developable Photosensitive Material Rise Curl | 78 | 74 | 32 | 45 | 30 | 24 |
| Flatness | B | A | A | A | A | A |
| Tg (° C.) | 119 | 120 | 118 | 120 | 120 | 120 |

As can be clearly seen from Table 4, in the case of the supports of the present invention and those which has been subjected to thermal treatment, the core-set curl is markedly minimized and the support flatness is also improved.

According to the present invention, it is possible to provide a photosensitive photographic material and a thermally developable photosensitive photographic material in which, in the case of rolled photosensitive photographic material such as graphic art material which is wound on a core having a relatively large diameter, roll-set curl tends not to occur and which exhibits excellent workability, and a photographic support which can be employed in the same.

What is claimed is:

1. A support of photographic material composed of a thermally fixed plastic film in which polyethylene naphthalate is the major component wherein the thermally fixed plastic film is thermally treated by heating the plastic film in a thermal treatment zone to a temperature of between Tg of said plastic film and its Tg plus 55° C.; and wherein the thermal treatment comprises moving the plastic film from an entry section to an exit section of the thermal treatment zone and wherein the temperature of the exit section is lower than that of the entry section.

2. The support of photographic material of claim 1, wherein the plastic film is thermally treated for 5 to 60 minutes.

3. The support of photographic material of claim 2 wherein the thermal treatment is carried out after a sublayer is coated and subsequently dried.

4. The support of photographic material of claim 1, wherein the thermal treatment comprises steps of heating up to a high temperature which does not exceed Tg of the plastic film+55° C. and cooling to not less the Tg of the plastic film.

5. The support of photographic material of claim 1 wherein the plastic film is composed of mixed resin comprising two or more types of polyester resins having different property or component.

6. The support of photographic material of claim 5 wherein the polyester resins have difference of semicrystallizing time at 250° C. obtained by the measurement employing a differential scanning calorimeter is not less than 5 minutes.

7. The support of photographic material of claim 1 wherein the thermal treatment is carried out after the plastic film is biaxially stretched.

8. The support of photographic material of claim 1 wherein the plastic film is composed of a mixed resin comprising two or more types of polyester resins having an intrinsic viscosity of 0.3 to 1.2, and an intrinsic viscosity difference of 0.2 to 1.0.

9. The support of photographic material of claim 8 wherein at least one of the polyester resins is polyethylene-2,6-naphthalate.

10. The support of photographic material of claim 8 wherein the polyester resin having a highest intrinsic viscosity is incorporated in an amount of 20 to 90 weight percent.

11. The support of photographic material of claim 1 wherein ratio $D_{145}/D_{135}$ is 0.8 to 1.4, wherein $D_{145}$ and $D_{135}$ are tan δ value at 145° C. and 135° C. respectively based on dynamic viscoelasticity measurement of the film.

12. The support of photographic material of claim 1 wherein the plastic film is thermally treated at a temperature of not less than its Tg plus 5° C. of said film to no more than its Tg plus 35° C.

13. The support of photographic material of claim 1 wherein the plastic film is thermally treated at moisture condition of between RH 50 and 100%.

14. The support of photographic material of claim 1 wherein the plastic film is, after biaxially stretched, thermally heated at a temperature of not less than its Tg of said film to no more than its Tg plus 55° C. then cooled to Tg; the plastic film is composed of a mixed resin comprising two or more types of polyester resins having an intrinsic viscosity of 0.3 to 1.2 and an intrinsic viscosity difference of 0.2 to 1.0; polyester resin having a lower intrinsic viscosity is incorporated in an amount of 10 to 80 weight percent.

15. The support of claim 1, wherein the temperature of the entry section is Tg+5 to Tg+35° C.

16. The support of claim 15, wherein the plastic film is thermally treated for 10 to 40 minutes.

17. The support of claim 16 further comprising the step of cooling the thermally treated plastic film to normal temperature at the rate of no less than −10° C./second.

18. A support of photographic material composed of a plastic film in which polyethylene naphthalate is the major component, wherein the plastic film is subjected to thermal treatment at a temperature of not less than Tg of said plastic film to no more than Tg of said plastic film plus 55° C., and the ratio of $D_{145}/D_{135}$ of the plastic film is 0.8 to 1.4, wherein $D_{145}$ and $D_{135}$ are tan δ value at 145° C. and 135° C. respectively based on dynamic viscoelasticity measurement of the plastic film.

19. The support of claim 18, wherein the thermal treatment is carried out in a thermal treatment zone for 10 to 40 minutes.

20. The support of claim 18, wherein the thermal treatment is carried out in a thermal treatment zone having an entry section and an exit section and the thermal treatment zone is set so that the temperature of the exit section is lower than that of the entry section.

21. The support of photographic material of claim 18, wherein the plastic film is composed of mixed resin comprising two or more types of polyester resins having different properties or components.

22. The support of photographic material of claim 18, wherein the plastic film is composed of a mixed resin comprising two or more types of polyester resins having an intrinsic viscosity of 0.3 to 1.2, and an intrinsic viscosity difference of 0.2 to 1.0.

23. The support of photographic material of claim 22, wherein the polyester resin having the highest intrinsic viscosity is incorporated in an amount of 20 to 90 weight percent.

24. The support of claim 20, wherein the temperature at the entry section is set in the range of Tg+5° C. to Tg+35° C.

25. The support of claim 24, wherein the thermal treatment is carried out for 10 to 40 minutes.

26. The support of claim 25, wherein the thermal treatment is carried out after a sublayer is coated.

27. The support of claim 19, wherein the thermal treatment is carried out after thermal fixing.

28. The support of claim 27, wherein the thermal treatment comprises the steps of: heating up to a high temperature which does not exceed the Tg+55° C. and cooling to the temperature of not less than Tg.

29. A photosensitive material comprising a support as defined in claim 18.

30. A support of photographic material composed of a plastic film wherein the plastic film comprises two or more types of polyester resins having a difference of semicrystallizing time at 250° C. obtained by measurement employing a differential scanning calorimeter of not less than 5 minutes and the plastic film is thermally treated at the temperature of not less than Tg of said plastic film to no more than Tg of the plastic film plus 55° C.

31. The support of claim 30, wherein the two or more types of polyester resins have a difference of semicrystallizing time at 250° C. obtained by measurement employing a differential scanning calorimeter of not less than 10 minutes.

32. The support of claim 31, wherein the two or more types of polyester resins have an intrinsic viscosity of 0.3 to 1.2, and an intrinsic viscosity difference of 0.2 to 1.0 and the polyester having the highest intrinsic viscosity is incorporated in an amount of 20 to 90 weight percent.

33. A photosensitive material comprising a support as defined in claim 30.

34. A method for forming a support of photographic material composed of a plastic film in which polyethylene naphthalate is the major component, comprising the steps of: thermally fixing the plastic film comprising polyethylene naphthalate; carrying out thermal treatment by heating the thermally fixed plastic film in a thermal treating zone in which the temperature is not less than Tg of said plastic film to no more than Tg of the plastic film plus 55° C.; and wherein the thermal treatment is carried out in a thermal treatment zone having an entry section and an exit section and wherein the temperature of the exit section is lower than that of the entry section.

35. The method of claim 34, wherein the temperature of the entry section is Tg+5 to Tg+35° C.

36. The method of claim 34, further comprising the step of cooling the thermally treated plastic film to normal temperature at the rate of no less than −10° C./second.

37. The method of claim 34, wherein the plastic film is thermally treated for 10 to 40 minutes.

38. The method of claim 36, wherein the thermal treatment is carried out for 10 to 40 minutes after a sublayer is coated and subsequently dried, so that the temperature of the exit section is lower than that of the entry section and the temperature at the entry section is Tg+5 to Tg+35° C.

39. The support of claim 37, wherein the thermal treatment comprises the steps of heating up to a high temperature which does not exceed Tg+55° C. and cooling thermal treatment zone to the temperature of not less than Tg.

40. The method of claim 37, wherein ratio of $D_{145}/D_{135}$ of the plastic film is 0.8 to 1.4, in which $D_{145}$ and $D_{135}$ are tan δ value at 145° C. and 135° C. respectively based on dynamic viscoelasticity measurement of the plastic film.

41. The method of claim 34, wherein the thermal treatment is carried out for 10 to 40 minutes after a sublayer is coated and subsequently dried, so that the temperature of the exit section is lower than that of the entry section and the temperature at the entry section is Tg+5 to Tg+35° C.

42. A photosensitive material comprising a support as defined in claim 34.

* * * * *